US009243635B2

(12) United States Patent
Hayashi et al.

(10) Patent No.: US 9,243,635 B2
(45) Date of Patent: Jan. 26, 2016

(54) COMPRESSOR WITH DIFFERENT RESIN HARDNESS LAYERS

(75) Inventors: Takeo Hayashi, Kusatsu (JP); Yuuichi Yamamoto, Kusatsu (JP); Masahide Higuchi, Kusatsu (JP); Chihiro Endou, Kusatsu (JP)

(73) Assignee: Daikin Industries, Ltd., Osaka (JP)

( * ) Notice: Subject to any disclaimer, the term of this patent is extended or adjusted under 35 U.S.C. 154(b) by 135 days.

(21) Appl. No.: 13/997,738

(22) PCT Filed: Dec. 19, 2011

(86) PCT No.: PCT/JP2011/079359

§ 371 (c)(1),
(2), (4) Date: Jun. 25, 2013

(87) PCT Pub. No.: WO2012/090760

PCT Pub. Date: Jul. 5, 2012

(65) Prior Publication Data

US 2013/0280117 A1 Oct. 24, 2013

(30) Foreign Application Priority Data

Dec. 27, 2010 (JP) ..... 2010-289811
Dec. 27, 2010 (JP) ..... 2010-289812

(51) Int. Cl.
*F04C 2/00* (2006.01)
*F01C 5/00* (2006.01)
(Continued)

(52) U.S. Cl.
CPC ..... *F04C 18/00* (2013.01); *F04C 18/32* (2013.01); *F04C 18/0207* (2013.01); *F04C 18/356* (2013.01); *F04C 2230/91* (2013.01); *F05C 2251/10* (2013.01); *F05C 2253/20* (2013.01)

(58) Field of Classification Search
CPC ..... F04C 2230/91; F04C 18/0207; F04C 18/356; F04C 18/00; F04C 18/32; F05C 2251/10; F05C 2253/20
USPC ..... 418/63, 152–153, 178, 149
See application file for complete search history.

(56) References Cited

U.S. PATENT DOCUMENTS 4,139,576 A 2/1979 Yoshimura et al.
4,177,320 A 12/1979 Yoshimura et al.
(Continued)

FOREIGN PATENT DOCUMENTS

CN 1796785 A 7/2006
CN 1910369 A 2/2007
(Continued)

OTHER PUBLICATIONS

International Search Report of corresponding PCT Application No. PCT/JP2011/079359, Jul. 11, 2013.
(Continued)

*Primary Examiner* — Mary A Davis
*Assistant Examiner* — Deming Wan
(74) *Attorney, Agent, or Firm* — Global IP Counselors

(57) ABSTRACT

A compressor includes a compression mechanism and a resin layer including a stack of three or more layers formed on a whole area or a portion of at least one surface of at least one part of the compression mechanism. A hardness of a layer most distant from a base in the resin layer is smaller than a hardness of a layer closest to the base in the resin layer. A difference in hardness between two adjacent layers in the resin layer is smaller than a difference in hardness between the layer most distant from the base and the layer closest to the base.

26 Claims, 25 Drawing Sheets

(51) Int. Cl.

| | |
|---|---|
| ***F01C 5/02*** | (2006.01) |
| ***F01C 5/04*** | (2006.01) |
| ***F04C 5/00*** | (2006.01) |
| ***F04C 18/00*** | (2006.01) |
| ***F04C 18/32*** | (2006.01) |
| *F04C 18/02* | (2006.01) |
| *F04C 18/356* | (2006.01) |

(56) References Cited

U.S. PATENT DOCUMENTS

| | | | | |
|---|---|---|---|---|
| 6,688,867 | B2 * | 2/2004 | Suman et al. | 418/178 |
| 2002/0141894 | A1 * | 10/2002 | Kirtley et al. | 418/152 |
| 2003/0111511 | A1 | 6/2003 | Kanayama et al. | |
| 2006/0140792 | A1 | 6/2006 | Tsuchiya et al. | |
| 2007/0225177 | A1 * | 9/2007 | Murase et al. | 508/104 |
| 2008/0025861 | A1 * | 1/2008 | Okawa et al. | 418/178 |
| 2008/0240961 | A1 | 10/2008 | Doi et al. | |
| 2010/0095837 | A1 | 4/2010 | Suman | |
| 2013/0174724 | A1 | 7/2013 | Tanigawa et al. | |

FOREIGN PATENT DOCUMENTS

| | | | |
|---|---|---|---|
| JP | 53-73222 | A | 6/1978 |
| JP | 62-253987 | A | 11/1987 |
| JP | 2-218883 | A | 8/1990 |
| JP | 6-101662 | A | 4/1994 |
| JP | 9-88855 | A | 3/1997 |
| JP | 2002-256371 | A | 9/2002 |
| JP | 2003-254262 | A | 9/2003 |
| JP | 2005-337129 | A | 12/2005 |
| JP | 2006-275280 | A | 10/2006 |
| JP | 2007-204602 | A | 8/2007 |
| JP | 2007-225013 | A | 9/2007 |
| WO | 02/075172 | A1 | 9/2002 |

OTHER PUBLICATIONS

International Search Report of related case PCT Application No. PCT/JP2011/0793323, Jul. 4, 2013.

Pending U.S. Appl. No. 13/996,767 (Hayashi et al.) filed Jun. 21, 2013.

European Search Report of corresponding EP Application No. 11 85 3218.3 dated Jul. 31, 2014.

European Search Report of related EP Application No. 11 85 0215.2 dated Jul. 22, 2014.

* cited by examiner

0° (UPPER DEAD CENTER)

90°

180° (LOWER DEAD CENTER)

FIG.7

| | HARD MATERIAL | SOFT MATERIAL |
|---|---|---|
| FIRST LAYER | 75% | 25% |
| SECOND LAYER | 55% | 45% |
| THIRD LAYER | 35% | 65% |
| FOURTH LAYER | 15% | 85% |

HARDNESS DIFFERENTIAL BETWEEN FIRST LAYER AND SECOND LAYER $\Delta L_{12}$

HARDNESS DIFFERENTIAL BETWEEN SECOND LAYER AND THIRD LAYER $\Delta L_{23}$

HARDNESS DIFFERENTIAL BETWEEN THIRD LAYER AND FOURTH LAYER $\Delta L_{34}$

HARDNESS DIFFERENTIAL BETWEEN FIRST LAYER AND FOURTH LAYER $\Delta L_{14}$

FIG. 11

| | HARD MATERIAL | SOFT MATERIAL |
|---|---|---|
| FIRST LAYER | 75% | 25% |
| SECOND LAYER | 55% | 45% |
| THIRD LAYER | 35% | 65% |

HARDNESS DIFFERENTIAL BETWEEN FIRST LAYER AND SECOND LAYER $\Delta L_{12}$

HARDNESS DIFFERENTIAL BETWEEN SECOND LAYER AND THIRD LAYER $\Delta L_{23}$

HARDNESS DIFFERENTIAL BETWEEN FIRST LAYER AND THIRD LAYER $\Delta L_{13}$

0° (UPPER DEAD CENTER)

90°

180° (LOWER DEAD CENTER)

270°

COMPRESSOR WITH DIFFERENT RESIN HARDNESS LAYERS

CROSS-REFERENCE TO RELATED APPLICATIONS

This U.S. National stage application claims priority under 35 U.S.C. §119(a) to Japanese Patent Application Nos. 2010-289811, filed in Japan on Dec. 27, 2010, and 2010-289812, filed in Japan on Dec. 27, 2010, the entire contents of which are hereby incorporated herein by reference.

TECHNICAL FIELD

The present invention relates to a compressor that compresses a refrigerant.

BACKGROUND ART

As a compressor, there has traditionally been a rotary compressor including a cylinder and a roller disposed inside the cylinder. In this rotary compressor, the roller is attached to a shaft that eccentrically rotates, and moves along the inner circumference surface of the cylinder with the rotation of the shaft.

In the rotary compressor, there is a minute gap between an end surface of a roller and an end plate member disposed to oppose this end surface, and between the outer circumference surface of the roller and the inner circumference surface of a cylinder, for the purpose of preventing seizure caused by sliding. The size of the gap is preferably as small as possible so as to prevent leakage of a refrigerant or lubricating oil. Even with such a gap however, the gap may close up and seizure may take place due to sliding, if the amount of thermal expansion of the roller is greater than that of the cylinder. Such a case may take place for example when the compressor is activated at a high speed.

Further, as a compressor other than the rotary compressor, there is a scroll compressor including a fixed scroll having a fixed-side wrap having a spiral shape, and a moveable scroll having a moveable-side wrap having a spiral shape that engages with the fixed-side wrap. In this scroll compressor, the moveable scroll is mounted to a shaft that eccentrically rotates, and circles with rotation of the moveable scroll.

In this scroll compressor, there is a small gap between an end surface of the wrap and a surface facing this end surface, and between a side surface of the wrap and a side surface (including a side surface of the other wrap) facing this side surface, for the purpose of preventing seizure caused by sliding. However, the gap closes up and seizure takes place, depending on the operation conditions.

To address the issue of seizure in the compressors, for example, Japanese Unexamined Patent Publication No. 275280/2006 (Tokukai 2006-275280) suggests a use of resin coating to improve the slidability. This allows prevention of seizure without enlarging the gap.

SUMMARY

Technical Problem

However, in addition to the above described problem of seizure, sliding movement also causes a problem that the efficiency of the compressor may deteriorated due to the frictional loss. The compressor of Japanese Unexamined Patent Publication No. 275280/2006 (Tokukai 2006-275280), with the resin coating, is able to prevent the seizure due to sliding; however, leaves the problem of deterioration in the efficiency of the compressor due to the frictional loss. Further, a resin coating layer swells by absorbing the refrigerant or the lubricating oil. Therefore, there is a possibility that the gap may close up not only in cases of activating the compressor at high speeds, but also in cases of ordinary operations. Therefore, when the surface of the resin coating slides in contact with the opposing member, the frictional loss increases due to the sliding.

A conceivable approach to restrain this problem is to reduce the hardness of the resin coating layer. If the resin coating layer is softened, the resin coating layer, even when sliding in contact with another member, is easily worn out or, if not, easily deformed. This reduces the surface pressure between contact surfaces, and thus reducing the frictional loss, and restrains deterioration in the efficiency of the compressor.

Meanwhile, if the hardness of the resin coating layer is reduced to the extent the hardness of the resin coating layer largely differs from that of a base such as roller, the adhesive strength between the resin coating layer and the base is weakened, and the resin coating layer is easily peeled from the base.

An object, of the present invention is to provide a compressor whose efficiency is restrained from deteriorating while a resin layer provided to an end surface of a piston or the like is prevented from separation from the base.

Solution to Problem

A first aspect of the present invention is a compressor, including a cylinder having a compression chamber and a blade housing in communication with the compression chamber; a first end plate member and a second end plate member which are disposed on both axial ends of the cylinder; and a piston disposed in the compression chamber and inside the blade housing, wherein the piston includes an annular roller disposed in the compression chamber and a blade extending from the outer circumference surface of the roller and disposed in the blade housing so as to be able to move forward and backward; a resin layer which is a stack of three or more layers is formed in a whole area or a portion of at least one of (1) an axial direction end surface of the piston; (2) a surface of the first end plate member, opposing to the axial direction end surface of the piston; (3) a surface of the second, end plate member, opposing to the axial direction end surface of the piston; (4) an outer circumference surface of the roller; and (5) an inner circumference surface of the compression chamber, the hardness of a layer most distant from a base in the resin layer is smaller than the hardness of a layer closest to the base in the resin layer, and a difference in the hardness of two adjacent layers in the resin layer is smaller than a difference between the hardness of the layer most distant from the base and the hardness of the layer closest to the base.

A second aspect of the present invention is a compressor, including: a cylinder having a compression chamber and a vane housing in communication with the compression chamber; a first end plate member and a second end plate member which are disposed on both axial ends of the cylinder; an annular roller disposed inside the compression chamber; and a vane having a leading end pressed against an outer circumference surface of the roller, which is disposed in the vane storage unit so as to be able to move forward and backward, wherein a resin layer which is a stack of three or more layers is formed in a whole area or a portion of at least one of (1) an axial direction end surface of the roller; (2) a surface of the first end plate member, opposing to the axial direction end surface of the roller; (3) a surface of the second end plate member, opposing to the axial direction end surface of the roller; (4) the outer circumference surface of the roller; and (5) an inner circumference surface of the compression chamber, the hardness of a layer most distant from a base in the resin layer is smaller than the hardness of a layer closest to the base in the resin layer, and a difference in the hardness of two adjacent layers in the resin layer is smaller than a difference between the hardness of the layer most distant, from the base and the hardness of the layer closest to the base.

A second aspect of the present invention is a compressor, including: a first scroll having a recess and a first wrap in a spiral shape, which projects from a bottom, surface of the recess; a second scroll having a recess and a second wrap in a spiral shape, which projects from a flat plate section, wherein the first scroll and the second scroll are closely located to each other so that the bottom surface of the recess and the flat plate section oppose to each other, and a side surface of the first wrap and a side surface of the second wrap oppose to each other, and wherein a resin layer which is a stack of three or more layers is formed in a whole area, or a portion of at least one of: (1) an end surface of the first wrap; (2) a surface opposing to the end surface of the first wrap on the flat plate section; (3) an end surface of the second wrap; (4) a surface opposing to the end surface of the second, wrap on the bottom surface of the recess; (5) the side surface of the first wrap; (6) the side surface of the second wrap; and (7) a circumference surface of the recess, the hardness of a layer most distant from a base in the resin layer is smaller than the hardness of a layer closest to the base in the resin layer, a difference in the hardness of two adjacent layers in the resin layer is smaller than a difference between the hardness of the layer most distant from the base and the hardness of the layer closest to the base.

In each of these compressors, the layer most distant from the base in the resin layer is soft. In cases of high-speed activation of the compressor or in cases where the compressor is operated under conditions such that the temperature of the refrigerant ejected significantly differs from the temperature of the incoming refrigerant, the amount of thermal expansion of the piston may be greater than that of the cylinder. This may lead to a problem that the resin layer swells by absorbing the lubricating oil, thus causing the layer most distant from the base to slide in contact with another member. However, even in such a case, the layer most distant from the base is easily worn out or, if not, easily deformed. This reduces the surface pressure between the contact surfaces, thus reducing the frictional loss, and restrains deterioration in the efficiency of the compressor. Further, by making the hardness of the layer closest to the base greater than that of the layer most distant from the base, the hardness of the layer closest to the base is approximated to the hardness of the base. This improves the adhesive strength between the resin layer and the base.

To achieve the above described effects, the hardness of the layer most distant from the base needs to made smaller than the hardness of the base. However, when the resin layer is structured by two layers, the difference between the hardness of the layer most distant from the base and that of the layer closest to the base becomes large, which may cause separation of the layer most distant from the base. In view of this problem, in each of the above compressors, the resin layer is structured by three or more layers, and a hardness differential of two adjacent layers is kept within a range smaller than a hardness differential between the layer most distant from the base and the layer closest to the base. This reduces the frictional loss, while improving the adhesive strength between the resin layer and the base, thereby preventing separation of the resin layer.

A fourth aspect of the present invention is the compressor of any one of the first to the third aspect adapted so that, among the three or more layers, the layer most distant from the base does not contain the anti-swelling agent.

Since the resin layer in this compressor contains the anti-swelling agent, the resin layer is kept from swelling by absorbing an oil or a refrigerant. Further, since the layer most distant from the base does not contain the anti-swelling agent, the anti-swelling agent does not abut the other member, even when the surface of the resin layer slides in contact with the other member. Therefore, as compared with a case where the layer most distant from the base contains an anti-swelling agent, the frictional loss is reduced while restraining deterioration in the efficiency of the compressor.

A fifth aspect of the present invention is the compressor of any one of the first to the fourth aspect adapted so that among the three or more layers, the layer closest to the base does not contain the anti-swelling agent.

Since the resin layer in this compressor contains the anti-swelling agent, the resin layer is kept from swelling by absorbing an oil or a refrigerant. Further, since the layer closest to the base does not contain the anti-swelling agent, weakening of the adhesive strength between the resin layer and the base, which is attributed to the anti-swelling agent, will not take place. Thus, unlike a case where the layer closest to the base contains the anti-swelling agent, it is possible to restrain separation of the resin layer from the base.

A sixth aspect of the present invention is the compressor of any one of the first to the fifth aspect adapted so that the hardness of each of the three or more layers is such that, the more distant the layer is from the base, the less the hardness of the layer becomes.

In the resin layer of this compressor, which is structured by three or more layers, the hardness differential between layers is kept small. This more effectively prevents separation of each layer in the resin layer.

A seventh aspect of the present invention is the compressor of any one of the first to the sixth aspect adapted so that the thickness of the layer most distant from the base is not more than 50% of the thickness of the resin layer.

In the compressor, the thickness of the layer most distant from the base, i.e., the layer softer than the layer closest to the base, is not more than 50% of the thickness of the entire resin layer. This restrains the amount of resin layer worn out by dusts such as chips generated by wear-out, as compared with a case where the entire resin layer is made a soft layer. Therefore, damages to the resin layer are kept, small.

An eighth aspect of the present invention is the compressor of any one of the first to the seventh aspect adapted so that, in the resin layer, the hardness of the layer most distant, from the base is smaller than the hardness of the surface opposing to the resin layer.

In this compressor, the hardness of the layer structuring the surface of the resin layer (i.e., layer most distant from the base) is lower than the hardness of the opposing component. Therefore, when the resin layer slides in contact with the opposing contact, due to swelling or the like, the layer most distant from the base is easily worn out. As the result, the surface pressure generated at the slide portion is reduced. This reduces the frictional loss and restrains deterioration in the efficiency of the compressor.

A ninth aspect of the present invention is the compressor of any one of the first to the eighth aspect adapted so that the bend elastic constant of at least one of three or more layers constituting the resin layer is smaller than the Young's modulus of at least one of two members disposed so as to sandwich the resin layer.

In this compressor, the bend elastic constant of at least one of the layers structuring the resin layer is small. Therefore, when the resin layer slides in contact with the opposing member, due to swelling or the like, the resin layer is easily elastically deformed. As the result, the surface pressure generated at the slide portion is reduced. This reduces the frictional loss and restrains deterioration in the efficiency of the compressor.

Advantageous Effects of Invention

As hereinabove described, the present invention brings about the following effects.

In the first to third aspects of the present invention, the layer most distant from the base in the resin layer is soft. In cases of high-speed activation of the compressor or in cases where the compressor is operated under conditions such that the temperature of the refrigerant ejected significantly differs from the temperature of the incoming refrigerant, the amount of thermal expansion of the piston may be greater than that of the cylinder. This may lead to a problem that the resin layer swells by absorbing the refrigerant or the lubricating oil, thus causing the layer most distant from the base to slide in contact with another member. However, even in such a case, the layer most distant from the base is easily worn out or, if not, easily deformed. This reduces the surface pressure between the contact surfaces, thus reducing the frictional loss, and restrains deterioration in the efficiency of the compressor. Further, by making the hardness of the layer closest to the base greater than that of the layer most distant from the base, the hardness of the layer closest to the base is approximated to the hardness of the base. This improves the adhesive strength between the resin layer and the base.

To achieve the above described effects, the hardness of the layer most distant from the base needs to made smaller than the hardness of the base. However, when the resin layer is structured by two layers, the difference between the hardness of the layer most distant from the base and that of the layer closest to the base becomes large, which may cause separation of the layer most distant from the base. In view of this problem, in each of first to third aspects of the present invention, the resin layer is structured by three or more layers, and a hardness differential of two adjacent layers is kept within a range smaller than a hardness differential between the layer most distant from the base and the layer closest to the base. This reduces the frictional loss, while improving the adhesive strength between the resin layer and the base, thereby preventing separation of the resin layer.

Since the resin layer in the fourth aspect of the present invention contains the anti-swelling agent, the resin layer is kept from swelling by absorbing an oil or a refrigerant. Further, since the layer most distant from the base does not contain the anti-swelling agent, the anti-swelling agent does not abut the other member, even when the surface of the resin layer slides in contact with the other member. Therefore, as compared with a case where the layer most distant from the base contains an anti-swelling agent, the frictional loss is reduced while restraining deterioration in the efficiency of the compressor.

In the fifth aspect of the present invention, since the resin layer contains the anti-swelling agent, the resin layer is kept from swelling by absorbing an oil or a refrigerant. Further, since the layer closest to the base does not contain the anti-swelling agent, weakening of the adhesive strength between the resin layer and the base, which is attributed to the anti-swelling agent, will not take place. Thus, unlike a case where the layer closest to the base contains the anti-swelling agent, it is possible to restrain separation of the resin layer from the base.

In the resin layer of the sixth aspect, which is structured by three or more layers, the hardness differential between layers is kept small. This more effectively prevents separation of each layer in the resin layer.

In the seventh aspect, the thickness of the layer most distant, from the base, i.e., the layer softer than the layer closest to the base, is not more than 50% of the thickness of the entire resin layer. This restrains the amount of resin layer worn out by dusts such as chips generated by wear-out, as compared with a case where the entire resin layer is made a soft layer. Therefore, damages to the resin layer are kept small.

In the eighth aspect of the present invention, the hardness of the layer structuring the surface of the resin layer (i.e., layer most distant from the base) is lower than the hardness of the opposing component. Therefore, when the resin layer slides in contact with the opposing contact, due to swelling or the like, the layer most distant from the base is easily worn out. As the result, the surface pressure generated at the slide portion is reduced. This reduces the frictional loss and restrains deterioration in the efficiency of the compressor.

In the ninth aspect of the present invention, the bend elastic constant of at least one of the layers structuring the resin layer is small. Therefore, when the resin layer slides in contact with the opposing member, due to swelling or the like, the resin layer is easily elastically deformed. As the result, the surface pressure generated at the slide portion is reduced. This reduces the frictional loss and restrains deterioration in the efficiency of the compressor.

BRIEF DESCRIPTION OF DRAWINGS

FIG. 7 is an explanatory diagram indicating a blending ratio of materials for the resin layer.

FIG. 11 is an explanatory diagram showing exemplary blending ratio of materials tier the resin layer.

DESCRIPTION OF EMBODIMENTS

<First Embodiment>

Figure 1:
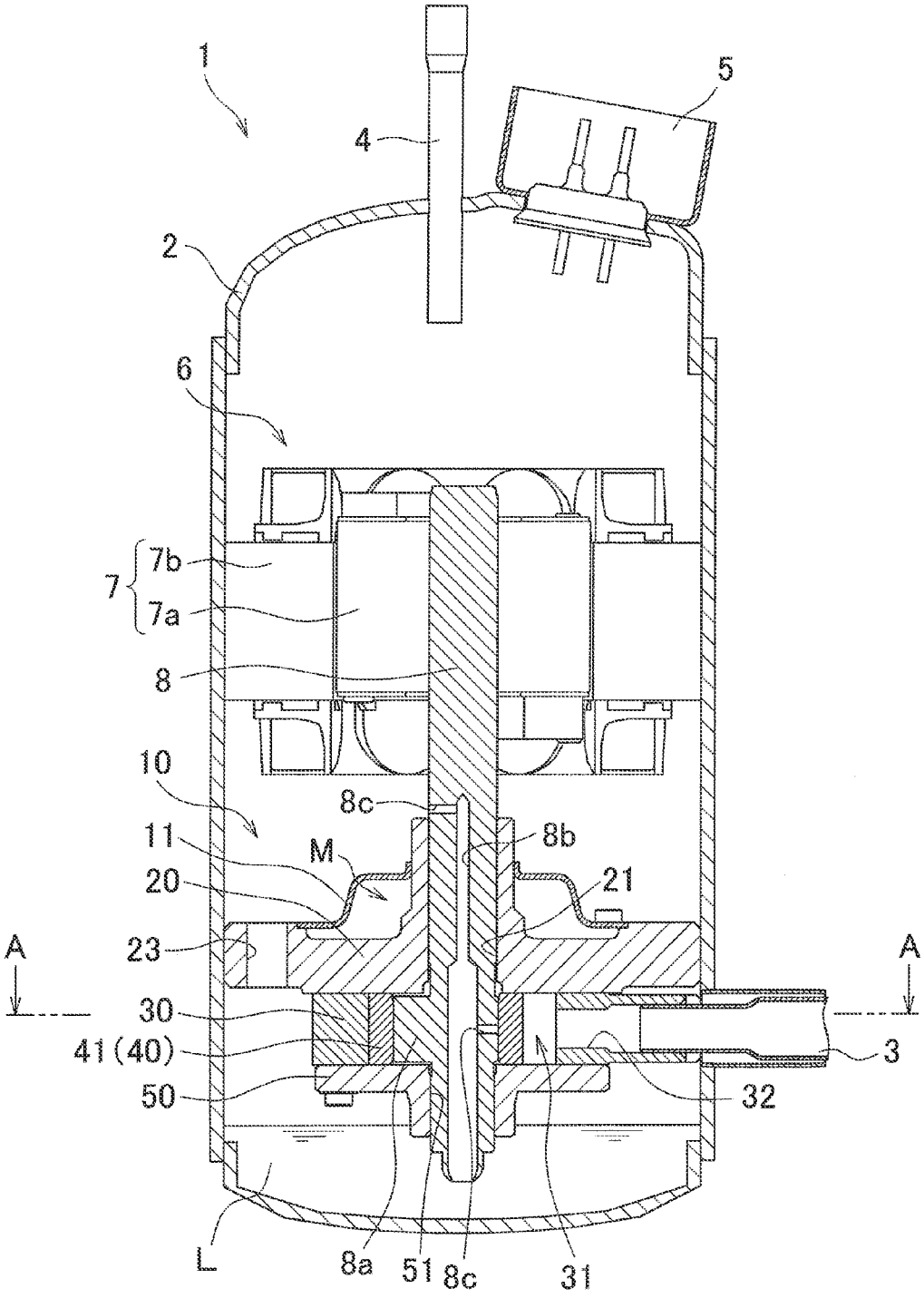
FIG. 1 is a schematic cross sectional view of a compressor related to First Embodiment, according to the present invention.
Figure 2A:
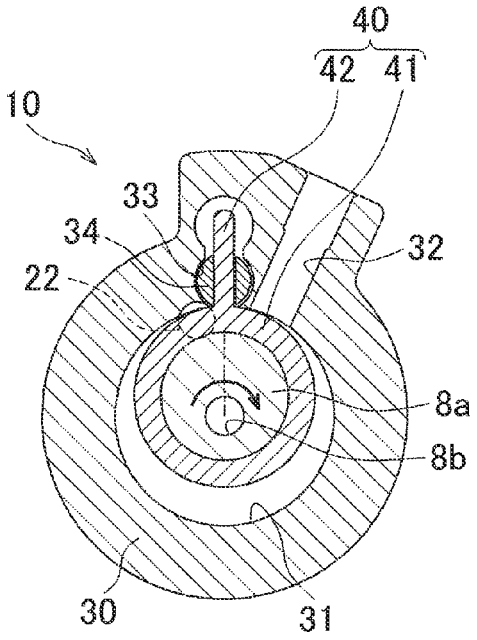
FIG. 2 is cross sectional view taken along line A-A of FIG. 1, and a diagram indicating an operation of a piston in a cylinder.
Figure 2B:
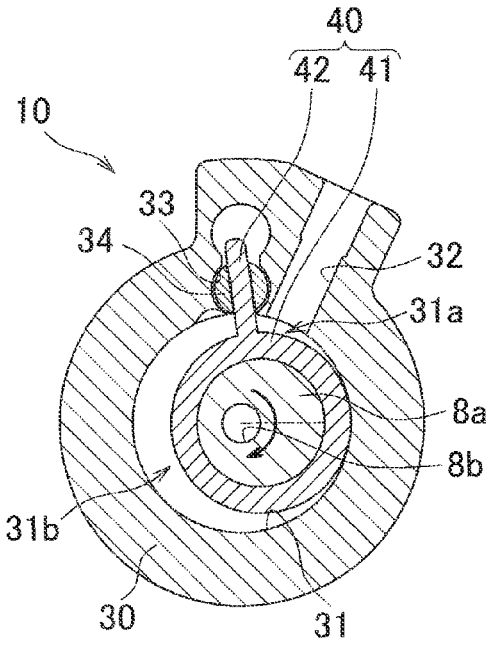
Figure 2C:
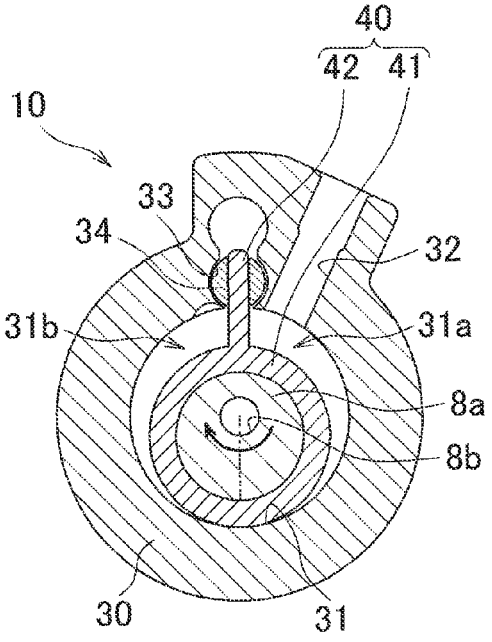
Figure 2D:
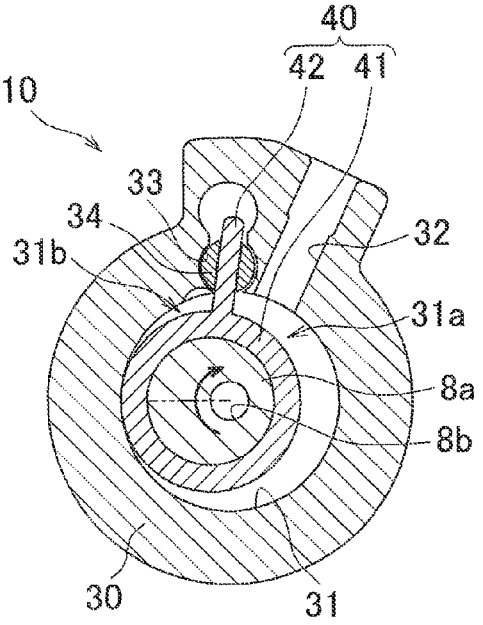

The following describes a first embodiment of the present invention. The present embodiment is an exemplary application of the present invention to a mono cylinder rotary compressor. As shown in FIG. 1, a compressor 1 of the present embodiment includes a closed casing 2 and a compressing structure 10 and a drive mechanism 6 disposed in the closed casing 2. Note that hatching for indicating the cross section of the drive mechanism 6 is omitted in FIG. 1. This compressor 1, which is for use in a refrigerating cycle such as an air conditioner, compresses a refrigerant (CO2 in the present embodiment) introduced from the inlet pipe fitting 3 and outputs the compressed refrigerant from the outlet pipe fitting 4. The following description of the compressor 1 assumes the up/down direction of FIG. 1 is the vertical direction.

The closed casing 2 is a cylindrical container with its both ends closed. On top of the casing 2 is provided an outlet pipe fitting 4 for output ting the compressed refrigerant, a terminal 5 for supplying currency to a later-mentioned coil of a stator 7*b* of the drive mechanism 6. Note that FIG. 1 omits illustration of wiring connecting the coil and the terminal 5. Further, on a side portion of the closed casing 2 is provided an inlet pipe fitting 3 for introducing the refrigerant to the compressor 1. Further, below the closed casing 2 is stored a lubricating oil L which smoothens the operation of a slide portion of the compressing structure 10. In the closed casing 2, the drive mechanism 6 and the compressing structure 10 are disposed up and down, respectively.

The drive mechanism 6 is provided for driving the compressing structure 10, and includes a motor 7 serving as a drive source, and a shaft 8 attached to the motor 7.

The motor 7 includes a substantially annular stator 7*b* which is fixed to the inner circumference surface of the closed casing 2, and a rotor 7*a* disposed on the radially inner side of the stator 7*b* with an air gap therebetween. The rotor 7*a* has a magnet (not shown), and the stator 7*b* has a coil. The motor 7 rotates the rotor 7*a* using the electromagnetic force generated by supplying of the currency to the coil. Further, the outer circumference surface of the stator 7*b* is not entirely in close contact with the inner circumference surface of the closed casing 2, i.e., a plurality of recesses (not shown) extending in the vertical direction and communicating the spaces above and below the motor 7 are provided along the outer circumference surface of the stator 7*b*.

The shaft 8 is for transmitting the drive force of the motor 7 to the compressing structure 10, and is fixed to the inner circumference surface of the rotor 7*a* to rotate integrally with the rotor 7*a*. Further, the shaft 8 has an eccentric portion 8*a* in a position serve as a later-mentioned compression chamber 31. The eccentric portion 8*a* is formed in a cylindrical manner, and its shaft center is deviated from the rotation center of the shaft 8. To this eccentric portion 8*a* is mounted a later-mentioned roller 41 of the compressing structure 10.

Further, inside a substantially lower half of the shaft 8 is formed a lubrication path 8*b* extended, in the vertical direction.

At the lower end portion of the lubrication path 8*b* is inserted a pump member (not shown) having a helical blade shape, which draws the lubricating oil L into the lubrication path 8*b* with rotation of the shaft 8. Further, the shaft 8 has a plurality of outlet holes 8*c* for outputting the lubricating oil L inside the lubrication path 8*b* to the outside the shaft 8.

The compressing structure 10 includes a front head (first end plate member) 20 fixed to the inner circumference surface of the closed casing 2, a muffler 11 disposed above the front head 20, a cylinder 30 disposed, below the front head 20, a piston 40 disposed inside the cylinder 30, and a rear head (second end plate member) 50 disposed below the cylinder 30. As shown in FIG. 2, the cylinder 30 is a substantially annular member with a compression chamber 31 formed, at its center portion. This is detailed later. The cylinder 30 is fixed to the lower side of the front head 20 by using a bolt, along with the rear head 50. Note that FIG. 2 omits illustration of a bolt hole which is formed on the cylinder 30.

Figure 3:
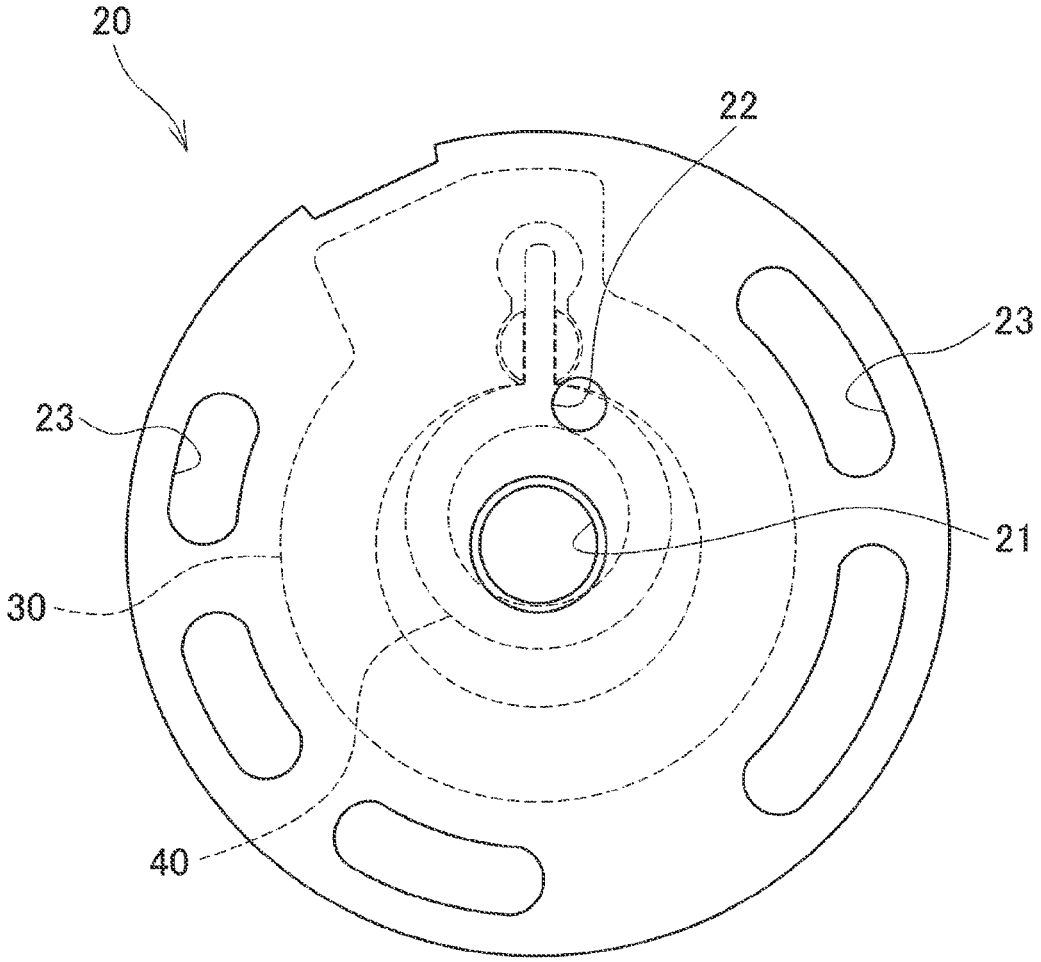
FIG. 3 is a bottom view of the front head shown in FIG. 1.

As shown in FIG. 1 and FIG. 3, the front head 20 is a substantially annular member, and its center portion has a bearing hole 21 into which the shaft 8 is rotatably inserted. The outer circumference surface of the front head 20 is fixed to the inner circumference surface of the closed casing 2 by means of spot welding or the like. The under surface of the front head 20 closes the upper end of the compression chamber 31 of the cylinder 30. On the front head 20 is formed a discharge hole 22 which ejects a refrigerant compressed in the compression chamber 31. The discharge hole 22, when viewed in the vertical direction, is formed nearby a later-mentioned blade housing 33 in the cylinder 30. On the top surface of the front head 20 is attached a valve structure which opens and closes the discharge hole 22 according to the pressure inside the compression chamber 31. Illustration of this however is omitted. Further, at a portion of the front head 20 radially outside of the cylinder 30, a plurality of oil-returning holes 23 are formed and aligned in the circumferential direction. The front head 20 is made of a metal material and example methods of manufacturing include sintering of metal powder, casting, and cutting.

The rear head 50 is a substantially annular member, and its center portion has a bearing hole 51 into which the shaft 8 is rotatably inserted. The rear head 50 closes the lower end of the compression chamber 31 of the cylinder 30. The rear head 50 is made of a metal material and example methods of manufacturing include sintering of metal powder, casting, and cutting.

The muffler 11 is provided for the purpose of reducing the noise generated at the time of ejecting the refrigerant from the discharge hole 22 of the front head 20. The muffler 11 is attached to the top surface of the front head 20 by using a bolt, and forms a muffler space M between the front head 20 and the muffler 11. Further, the muffler 11 has a muffler discharge hole for discharging the refrigerant in the muffler space M.

As shown in FIG. 1 and FIG. 2, in the cylinder 30 are formed the above-mentioned compression chamber 31, a draw-in hole 32 for introducing the refrigerant, inside the compression chamber 31, and a blade housing 33. Note that FIG. 2 (*a*) is a cross sectional view taken along the line A-A of FIG. 1, and the discharge hole 22 on the front head 20 is not supposed to be shown. However, for the sake of convenience, the discharge hole 22 is shown in the figure. The cylinder 30 is made of a metal material and example methods of manufacturing include sintering of metal powder, casting, and cutting.

The draw-in hole 32 extends in a radial direction of the cylinder 30, and a leading end of the inlet pipe fitting 3 is inserted into the end portion (the end portion opposite to the compression chamber 31) of the draw-in hole 32.

The blade housing 33 penetrates the cylinder 30 in the vertical direction, and is in communication with the compression chamber 31. The blade housing 33 extends in a radial direction of the compression chamber 31. The blade housing 33, when viewed in the vertical direction, is formed between the draw-in hole 32 and the discharge hole 22 of the front head 20. Inside the blade housing 33 is a pair of bushes 34. The pair of bushes 34 each has a shape such that a substantially cylindrical member is cut in half. Between the pair of bushes 34 is disposed a blade 42. The pair of bushes 34 is capable of moving within the blade housing 33, in the circumferential direction, while the blade 42 disposed, therebetween.

Figure 4:
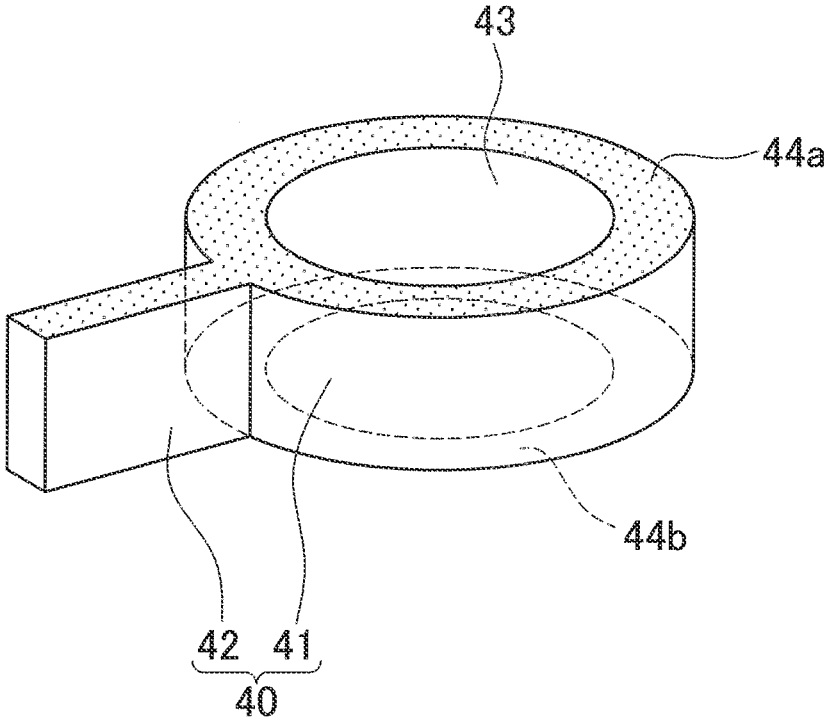
FIG. 4 is a perspective diagram of the piston shown FIG. 1.

As shown in FIG. 4, the piston 40 has an annular roller 41, and a blade 42 extended, radially outward from the outer circumference surface of the roller 41. As shown in FIG. 2, the roller 41 is disposed in the compression chamber 31, and is mounted to the outer circumference surface of the eccentric portion 8*a* so that relative rotation is possible. The blade 42 is disposed between the pair of bushes 34 in the blade housing 33 and is capable of moving forward and backward.

As shown in FIG. 2 (*b*) to FIG. 2 (*a*), the space formed between the outer circumference surface of the roller 41 and the circumferential wall of the compression chamber 31, while the blade 42 is relatively out of the compression chamber 31 of the blade housing 33, is divided into a low pressure chamber 31*a* and a high pressure chamber 31*b* by the blade 42.

Figure 5A:
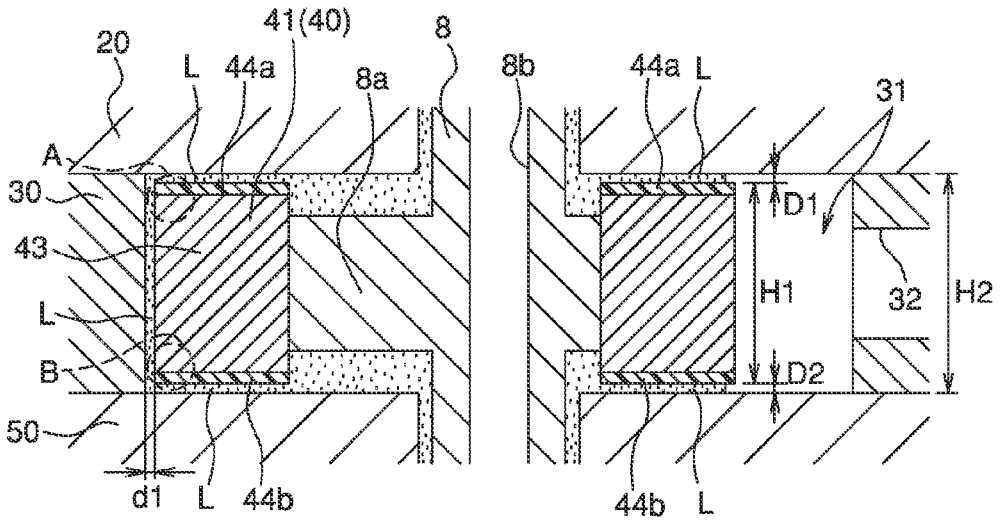
FIG. 5 is a schematic diagram providing a partially enlarged view of a compressing structure shown in 1, wherein FIG. 1(*a*) shows a state where the resin layer is not swollen, and FIG. 1 (*b*) shows a state where the resin layer is swollen.
Figure 5B:
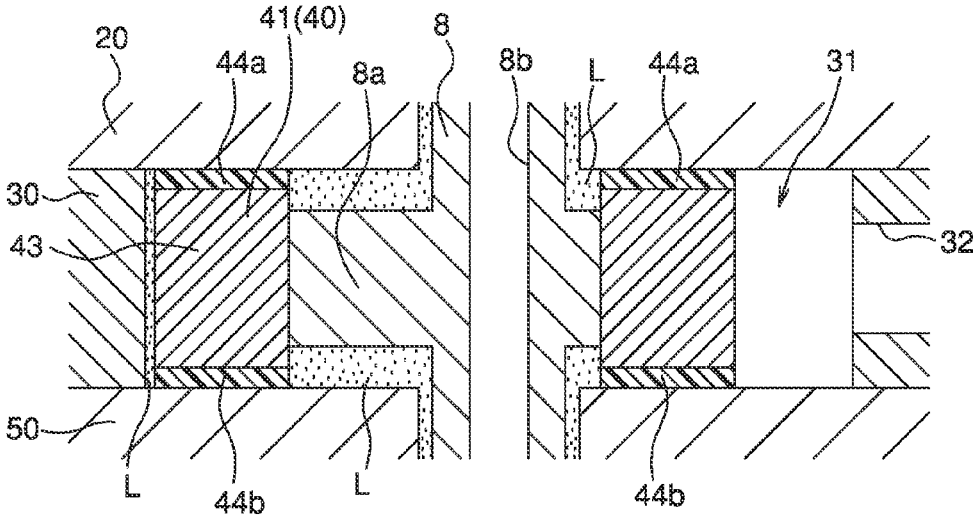

The FIG. 5 (*a*) snows the compressor 1 at the time of shipment. As shown in FIG. 5 (*a*), a vertical length H1 of the piston 40 at the time of shipment is slightly smaller than a vertical length H2 of the compression chamber 31, and the difference is, for example, 5 to 15 μm. Further, the external diameter of the roller 41 is such that, while the roller 41 is mounted to the eccentric portion 8*a*, a minute gap d1 of approximately 5 to 30 μm, for example, is formed between the outer circumference surface of the roller 41 and the circumferential wall of the compression chamber 31 (the gap is hereinafter referred to as radial-directional gap d1).

<Resin Layers>

Figure 6A:
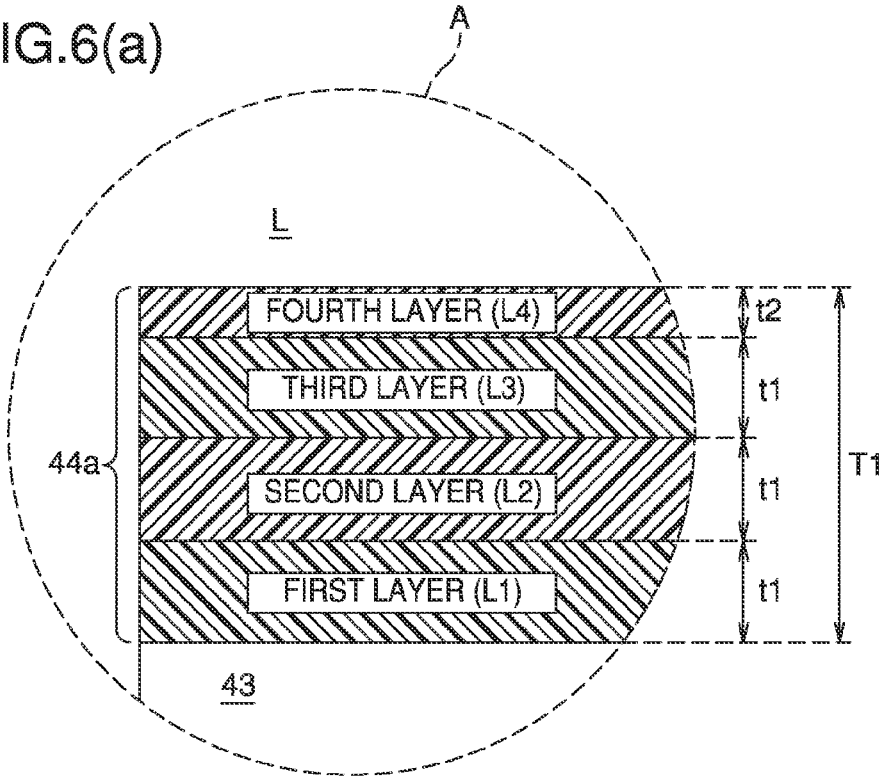
FIG. 6(*a*) is an enlarged view of an area circled by a broken line A in FIG. 5 (*a*), and FIG. 6(*b*) is an enlarged view of an area circled by a broken line B in FIG. 5 (*a*).
Figure 6B:
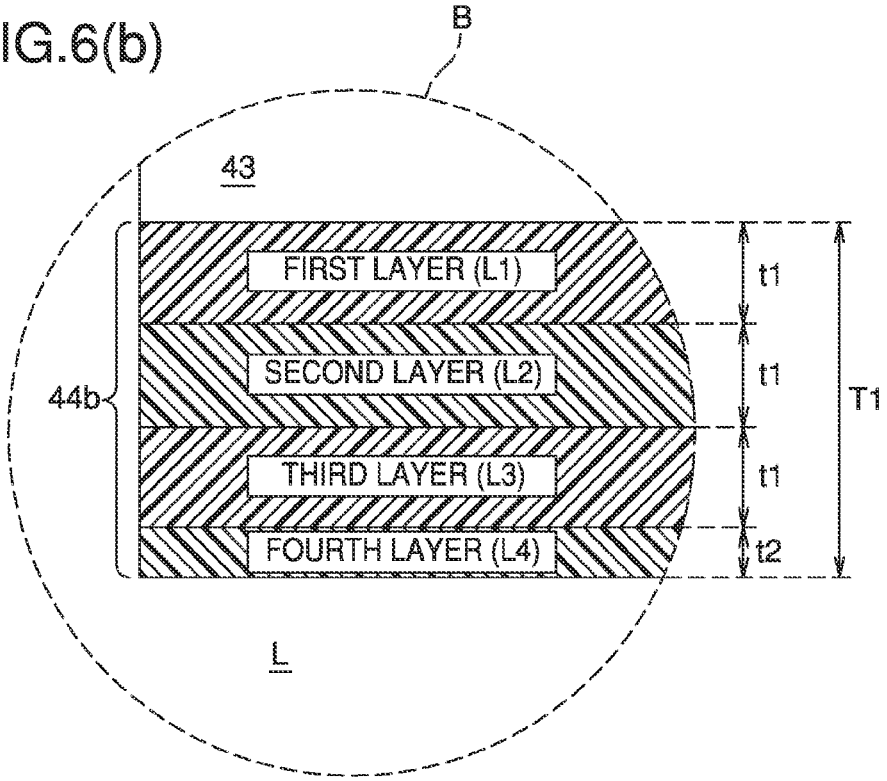

As shown in FIG. 4, FIG. 5 (*a*), and FIG. 6, the piston 40 of the present embodiment includes: a base 43 of the metal material, a resin layers 44*a*, 44*b* which are each a thin film, coating the surfaces of the base 43. The outer shape of the base 43 constitutes substantially the outer shape of the piston 40. The base 43 is made by sintering of metal powder, casting, cutting or the like, and the surface thereof is polished.

The resin layers 44*a*, 44*b* coats the top surface and the under surface of the base 43, respectively. That is, the resin layers 44*a*, 44*b* are formed on the upper and lower end surfaces of the piston, respectively. Further, the resin layers 44*a*, 44*b* are hardly swollen at the time of shipment of the compressor 1 (slightly swollen, or not at all swollen). The thickness of each of the resin layers 44*a*, 44*b* at this time is, for example, approximately 10 to 20 μm. Note that the thickness is not limited to the thickness.

As shown in FIG. 6 (*a*) and FIG. 6 (*b*), resin layers 44*a*, 44*b* are each a stack of four layers including a first layer closest to the base 43, a second layer, a third layer, and a fourth layer stacked in this order on the outside of the first layer. The fourth layer is farthest among the four layers from, the base 43. The second layer and the third layer are disposed between the first layer and the fourth layer, and connect the first layer and the fourth layer. The thickness t1 of each of the first to third layers is the same and the thickness t2 of the fourth layer is smaller than the thickness t1 of each of the first to third, layers. The thickness t2 of the fourth, layer is not more than 50% of the entire thickness T1(=3×t1+t2) of each of the resin layers 44*a*, 44*b*. Further, in each of the resin layers 44*a*, 44*b*, the second layer and the third layer are each a layer containing an anti-swelling agent which prevents the layer from swelling even when an oil or a refrigerant is absorbed. The first layer closest to the base 43 and the fourth layer most distant, from the base 43 on the other hand do not contain the anti-swelling agent. Therefore, the second layer and the third layer are restrained from swelling as compared with the first layer and the fourth layer. The anti-swelling agent may be for example aluminum (Al), alumina, silicon nitride ($Si_3N_4$), calcium fluoride ($CaF_2$, wood chips, and the like. Note that, in FIG. 6 (*a*) and FIG. 6 (*b*), the reference numerals L1 to L4 shown in parenthesis in each of the resin layers 44*a*, 44*b* indicate the hardness of the first layer to the fourth layer, respectively. Further, the hardness of the second layer and that of the third layer are each hardness of portions of the layer other than the anti-swelling agent.

FIG. 7 shows an exemplary blending ratio (%) of two types of materials, i.e., a hard material and a soft material, blended in each of the resin layers 44*a*, 44*b*. More specifically, the hard material may be PAI (polyimide amide), FEP (tetrafluoro ethylene.hexafluoropropylene copolymer), or a combination of these materials. Further, the soft material may be PTFE (poly tetrafluoro ethylene), graphite, $MoS_2$ (molybdenum disulfide), or a combination of these materials.

As shown in FIG. 7, the blending ratio of the hard material and the soft material varies in four stages from the layer closest to the base 43. The number of stages is the same as the number of the layers. Namely, the blending ratio of the hard material is 75% in the first layer, 55% in the second layer, 35% in the third layer, and 15% in the fourth layer. As such, the more distant the layer is from the base 43, the less the blending ratio of the hard material becomes. On the other hand, the blending ratio of the soft material is 25% in the first layer, 45% in the second layer, 65% in the third layer, and 85% in the fourth layer. As such, the more distant the layer is from the base 43, the more the blending ratio of the soft material becomes. In other words, the hardnesses L1 to L4 of the resin layers 44*a*, 44*b* are such that, the more distant the layer is from the base 43, the less the hardness becomes. Further, the difference in the hardness between adjacent two layers out of the resin layers 44*a*, 44*b* is as follows. Namely, the hardness differential ΔL12 (=L1−L2) between the first layer and the second layer, the hardness differential ΔL23(=L2−L3) between the second layer and the third layer, the hardness differential ΔL34(=L3−L4) between the third layer and the fourth layer are all smaller than the hardness differential ΔL14 (=L1−L4) between hardness L4 of the fourth layer most distant from the base 43 and the hardness L1 of the first layer closest to the base 43. The adhesive strength between two adjacent layers increases with a decrease in the hardness differential. Therefore, in the present embodiment, the adhesive strength between the first layer and the second layer, the adhesive strength between the second layer and the third layer, and the adhesive strength between the third layer and the fourth layer are all greater than the adhesive strength between the first layer and the fourth layer in cases of forming the fourth layer on the surface of the first layer.

Further, the hardness of the fourth layer most distant from the base 43 is smaller than that of the metal material constituting the front head 20 and the rear head 50. Note that, in the present embodiment, the hardnesses of the rest of three layers are also smaller than that of the metal material constituting the front head 20 and the rear head 50. Further, the bend elastic constant of each layer constituting the resin layers 44*a*, 44*b* is smaller than the Young's modulus of the metal material constituting the base 43, the front head 20, and the rear head 50. Note that the "two members provided so as to sandwich the resin layer" are base 43 and the front head 20 in cases of the resin layer 44*a* provided on the top surface of the piston 40, and are base 43 and the rear head 50 in cases of the resin layer 44*b* provided on the under surface of the piston 40.

<Operation of Compressor>

Next, the following describes an operation of the compressor 1 of the present embodiment, with reference to FIG. 2 (*a*) to FIG. 2 (*d*). FIG. 2 (*a*) shows a state where the piston 40 is at the upper dead center, and FIG. 2 (*b*) to FIG. 2 (*d*) show states where the shaft 8 has rotated by 90°, 180° (lower dead center), and 270° from the state of FIG. 2 (*a*), respectively.

Driving the motor 7 to rotate the shaft 8, while the refrigerant is supplied from the inlet pipe fitting 3 to the compression chamber 31 through the draw-in hole 32, causes the roller 41 mounted to the eccentric portion 8*a* to move along the circumferential wall of the compression chamber 31, as shown in FIG. 2 (*a*) to FIG. 2 (*d*). This way, the refrigerant is compressed in the compression chamber 31. The following details how the refrigerant is compressed.

When the eccentric portion 8*a* rotates from, the state shown in FIG. 2 (*a*) in the direction of the arrow in the figure, the space formed between the outer circumference surface of the roller 41 and the circumferential wall of the compression chamber 31 is divided into the low pressure chamber 31*a* and the high pressure chamber 31*b*, as shown in FIG. 2 (*b*). When the eccentric portion 8*a* further rotates, the volume of the low pressure chamber 31*a* increases as shown in FIG. 2 (*b*) to FIG. 2 (*d*), and therefore, the refrigerant is drawn from the inlet pipe fitting 3 to the low pressure chamber 31*a* through the draw-in hole 32. At the same time, the volume of the high pressure chamber 31*b* decreases, and this compresses the refrigerant in the high pressure chamber 31*b*.

When the pressure inside the high pressure chamber 31*b* is a predetermined pressure, the valve structure provided to the front head 20 is opened and the refrigerant in the high pressure chamber 31*b* is ejected to the muffler space M through the discharge hole 22. After that, the eccentric portion 8*a* returns to the state shown in FIG. 2 (*a*), and ejection of the refrigerant from the high pressure chamber 31*b* is completed. Repeating this process enables successive compression and ejection of the refrigerant supplied from the inlet pipe fitting 3 to the compression chamber 31.

The refrigerant, ejected to the muffler space M is ejected outside the compressing structure 10 from the muffler discharge hole (not shown) of the muffler 11. The refrigerant ejected from the compressing structure 10 passes through an air gap between the stator 7*b* and the rotor 7*a*, or the like, and then finally discharged outside the closed casing 2 from the outlet pipe fitting 4.

At this time the lubricating oil L supplied to the compression chamber 31 from the outlet hole 8*c* of the shaft 8 is partially ejected to from the discharge hole 22 to the muffler space M along with the refrigerant, and then, ejected from the muffler discharge hole (not shown) of the muffler 11 to the outside the compressing structure 10. The lubricating oil L ejected to the outside the compressing structure 10 is partially returned to the storage at the bottom of the closed casing 2 through the oil-returning hole 23 of the front, head 20. Further, another part of the lubricating oil L ejected to the outside the compressing structure 10 passes the air gap between the stator 7*b* and the rotor 7*a* along with the refrigerant, and then returns to the storage at the bottom, of the closed, casing 2, through the gap between the recess (not shown) formed on the outer circumference surface of the stator 7*b* and the inner circumference surface of the closed casing 2, and the oil-returning hole 23 of the front head 20.

As described, the vertical length of the piston 40 is slightly smaller than the vertical length of the compression chamber 31. Therefore, during the ordinary operation of the compressor 1, the lubricating oil L ejected from the outlet hole 8*c* of the shaft 8 exists in the minute gap D1 between the upper end surface of the piston 40 and the front head 20, and in the minute gap D2 between the lower end surface of the piston 40 and the rear head 50 (hereinafter, these gaps are referred to as axial directional gaps D1, D2), as shown in FIG. 5 (*a*).

Further, as hereinabove described, the external diameter of the roller 41 is such that, while the roller 41 is mounted to the eccentric portion 8*a*, there is a minute radial-directional gap d1 between the circumferential wall of the compression chamber 31 and the outer circumference surface of the roller 41. Therefore, during the ordinary operation of the compressor 1, the lubricating oil L discharged from the outlet hole 8*c* of the shaft 8 is in the radial-directional gap d1, as shown in FIG. 5 (*a*).

[Characteristics of Compressor of First Embodiment]

In the compressor 1 of the present embodiment, the fourth layer most distant from the base 43 in the resin layers 44*a*, 44*b* is soft. In cases of high-speed activation of the compressor 1 or in cases where the compressor is operated under conditions such that the temperature of the refrigerant ejected significantly differs from the temperature of the incoming refrigerant, the amount of thermal expansion of the piston 40 may be greater than that of the cylinder 30. This may lead to a problem that the resin layers 44*a*, 44*b* swell by absorbing the refrigerant or the lubricating oil L, thus causing the fourth layer most distant from the base 43 to slide in contact with the front head 20 or the rear head 50 as shown in FIG. 5 (*b*). However, even in such a case, the fourth layer most distant from, the base 43 is easily worn out or, if not, easily deformed. This reduces the surface pressure between the contact surfaces, thus reducing the frictional loss, and restrains deterioration in the efficiency of the compressor 1.

By making the hardness L1 of the first layer closest to the base 43 greater than the hardness L4 of the fourth layer most distant from the base 43, the hardness L1 of the first layer closest to the base 43 is approximated, to the hardness of the base 43. This improves the adhesive strength between the resin layers 44*a*, 44*b* and the base 43.

Further, in the compressor 1 of the present embodiment, the resin layers 44*a*, 44*b* are each made of four layers, and hardness differential between two adjacent layers (ΔL12, ΔL23, ΔL34) is kept smaller than the hardness differential ΔL14 between the fourth layer most distant from the base 43 and the first layer closest to the base 43. This reduces the frictional loss and prevents separation of the layers (first layer to fourth, layer) included in each of the resin layers 44*a*, 44*b*, while improving the adhesive strength between the resin layers 44*a*, 44*b* and the base 43.

Further, in the compressor 1 of the present embodiment, the resin layers 44*a*, 44*b* contains an anti-swelling agent. This prevents the resin layers 44*a*, 44*b* from swelling by absorbing an oil or a refrigerant.

Further, of the first layer to the fourth layer in each of the resin layers 44*a*, 44*b*, the fourth layer most distant from the base 43 does not contain the anti-swelling agent. Therefore, when the surface of the resin layers 44*a*, 44*b* slides in contact with the front head 20 and the rear head 50, the anti-swelling agent does not abuts the front head 20 and the rear head 50. This reduces a frictional loss and restrains deterioration in the efficiency of the compressor 1, as compared with cases where the fourth layer contains the anti-swelling agent.

Further, of the first layer to the fourth layer in each of the resin layers 44*a*, 44*b*, the first layer closest, to the base 43 does not contain the anti-swelling agent. Therefore, a decrease in the adhesive strength between the resin layers 44*a*, 44*b* and the base 43 which is attributed to the anti-swelling agent does not take place. It is therefore possible to prevent separation of the resin layers 44*a*, 44*b* from the base 43, as compared with cases where the first layer contains an anti-swelling agent.

Further, in the compressor 1 of the present embodiment, the thickness t2 of the fourth layer which is softer than the first layer closest to the base 43 is kept not more than 50% of the thickness T1 of each of the resin layers 44*a*, 44*b*. This reduces the amount of the resin layers 44*a*, 44*b* being worn out by dusts such as chips generated by wear-out, as compared with cases where the entire resin layers 44*a*, 44*b* is made as soft as the fourth layer is. Accordingly, damages to the entire resin layers 44*a*, 44*b* is kept small.

Further, in the compressor 1 of the present embodiment, the hardness of the fourth layer most distant, from the base 43 is smaller than the hardnesses of the front head 20 and the rear head 50. Thus, when the resin layers 44*a*, 44*b* swell and slides in contact with the front head 20 or the rear head 50, the fourth layer most distant from the base 43 is easily worn out.

Further, in the compressor 1 of the present embodiment, the bend elastic constant of the four layers constituting each of the resin layers 44*a*, 44*b* is small. Thus, when the resin layers 44*a*, 44*b* slides in contact with the front head 20 or the rear head 50, due to swelling of the resin layers 44*a*, 44*b*, or the like, the resin layers 44*a*, 44*b* are easily elastically deformed.

(Second Embodiment)

Next, the following describes Second Embodiment, according to the present invention. A compressor of the present embodiment is different from the compressor of the First Embodiment in that the resin layer is provided not on the piston 40, but on the front head or the rear head. Note that, elements of the present embodiment identical to those described in First Embodiment are given the same reference numerals and details for these elements are omitted.

<Resin Layer>

Figure 8:
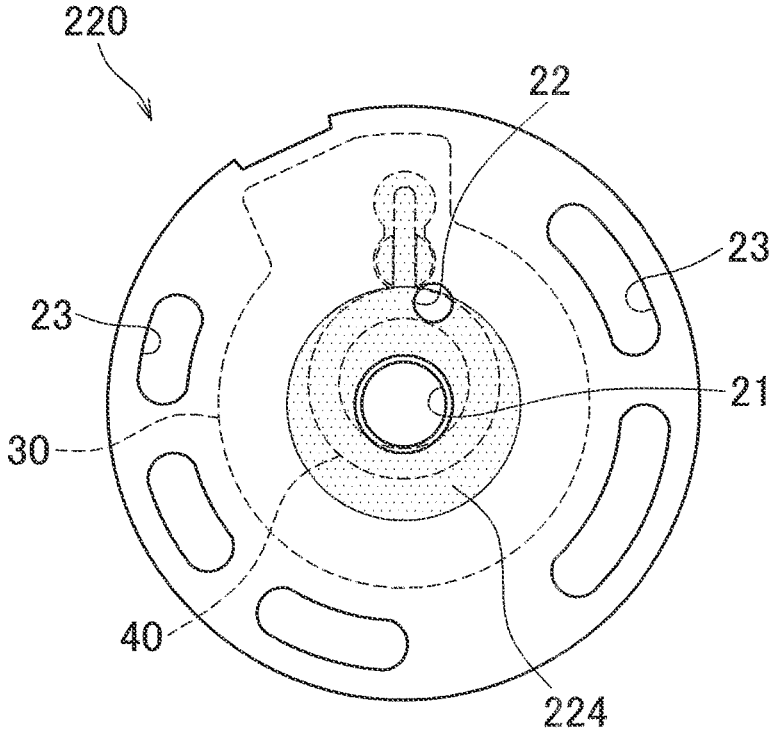
FIG. 8 is a diagram providing a bottom view of the front head in a compressor, related to Second Embodiment, according to the present invention.
Figure 9A:
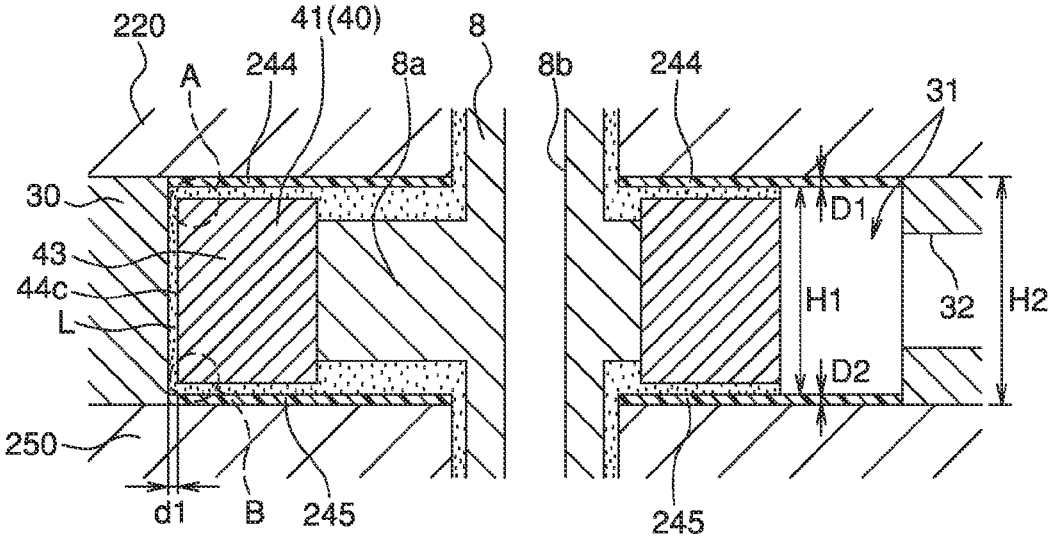
FIG. 9 is a diagram schematically illustrates a partially enlarged view of a compressing structure, wherein FIG. 9(*a*) shows a state where the resin layer is not swollen, and FIG. 9(*b*) shows a state where the resin layer is swollen.
Figure 9B:
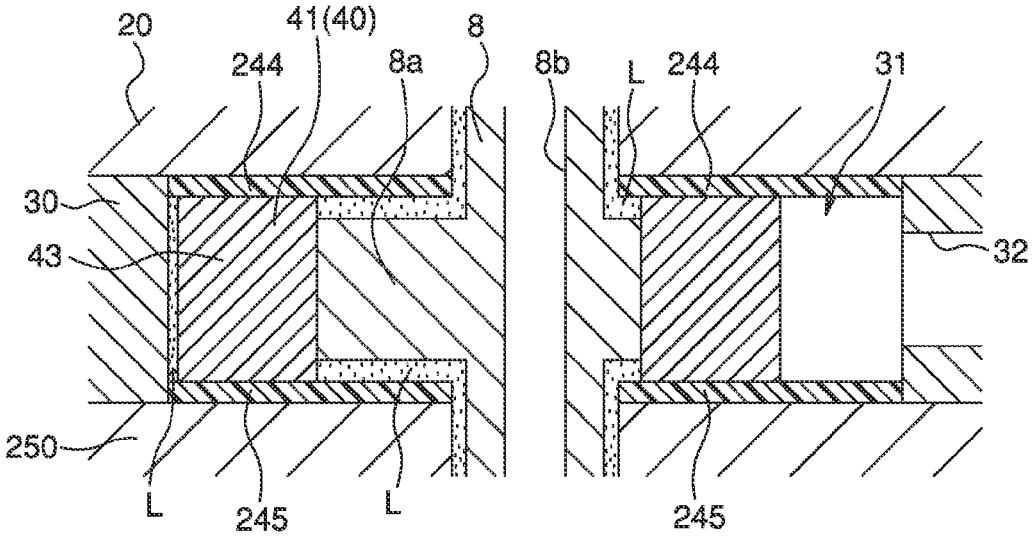

As shown in FIG. 8 and FIG. 9 (*a*), a front head 220 of the present, embodiment has on its under surface a resin layer 244 in the form of thin film. Although illustration is omitted in FIG. 8, a rear head 250 also has on its top surface a resin layer 245 in the form of thin film (see FIG. 9(*a*), FIG. 9(*b*)). As shown in FIG. 8, the resin layer 244 is formed in an area including an area where the top surface of the piston 40 slides (hatched area in the figure). Similarly, the resin layer 245 is formed in an area, including an area, where the under surface of the piston 40 slides.

Figure 10A:
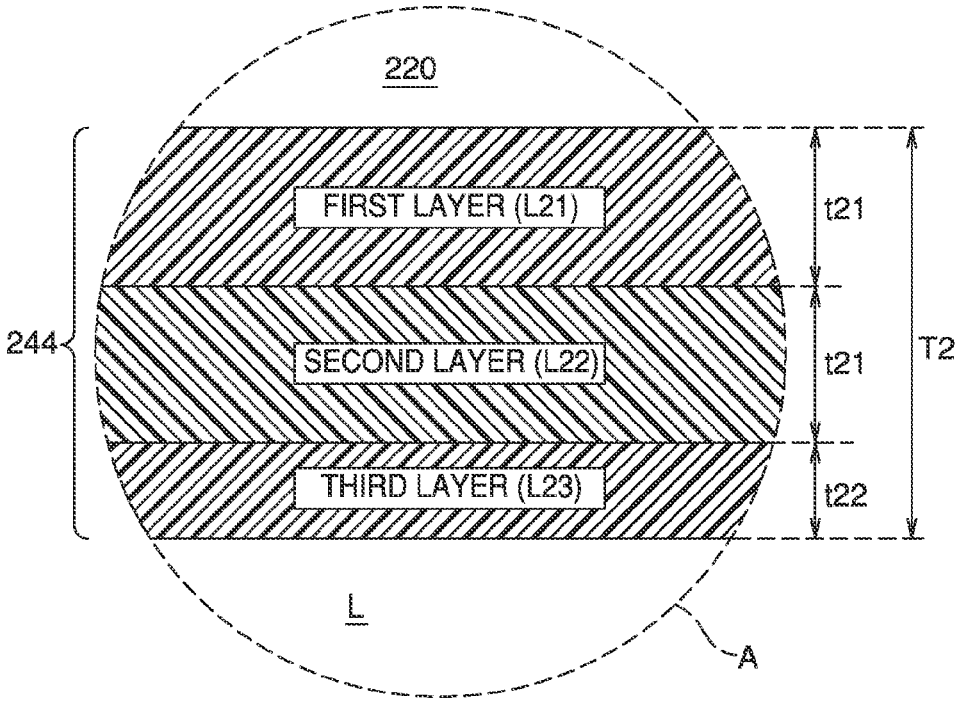
FIG. 10(*a*) is an enlarged view of an area circled by a broken line A in FIG. 9 (*a*), and FIG. 10(*b*) is an enlarged view of an area circled by a broken line Bin FIG. 9 (*a*).
Figure 10B:
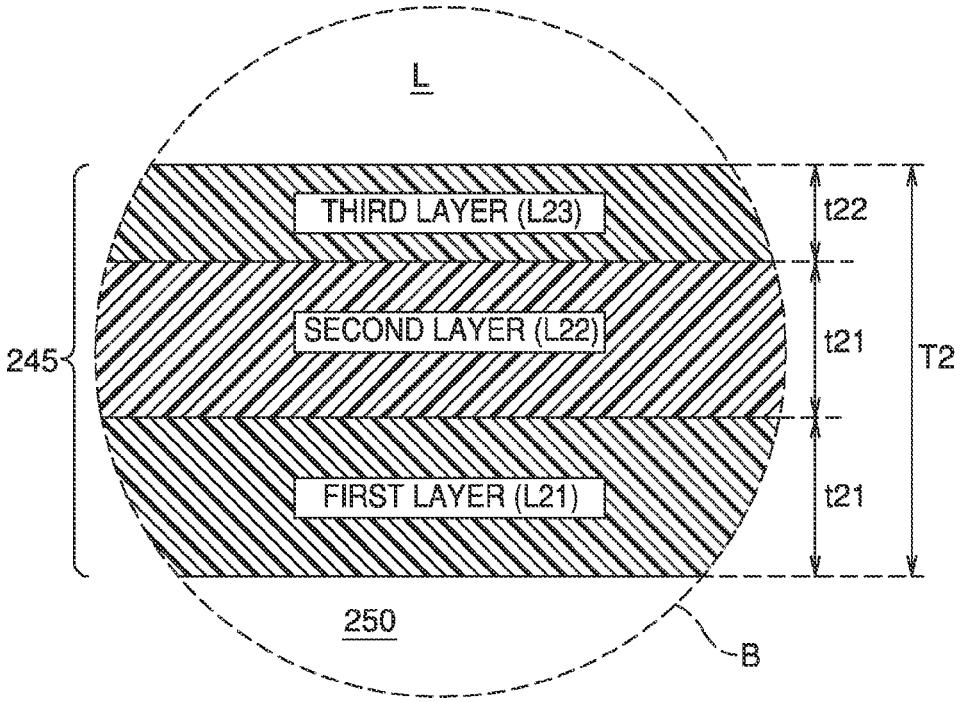

As shown in FIG. 10(*a*), FIG. 10(*b*), each of the resin layers 244, 245 is a stack of three layers, i.e., a first layer closest to the front head 220 or the rear head 250, and a second layer and a third layer which are stacked in this order towards outside. That is, the third layer is most distant from the base of the front head 220 or the rear head 250. The second layer is disposed between the first layer and the third layer, and connects the first layer with the third layer. Further, the thickness t21 of each of the first layer and the second layer is the same, and the thickness t22 of the third layer is smaller than the thickness t21 of each of the first layer and the second layer. Thus, the thickness t22 of the third layer is not more than 50% of the thickness T2(=2×t21+t22) of the resin layers 244, 245. Further, in the resin layers 244, 245, the second layer contains an anti-swelling agent which prevents swelling of the layer even when an oil of a refrigerant is absorbed, and the first layer closest to the base and the third layer most distant from the base do not contain the anti-swelling agent. Thus, the second layer is kept from swelling as compared with the first layer and the third layer. Note that, in FIG. 10(*a*) and FIG. 10 (*b*), the reference numerals L21 to L23 shown in par entries is in each of the resin layers 244, 245 indicate the hardness of the first layer to the third layer. Further, the hardness of the second layer is hardness of portions of the layer other than the anti-swelling agent.

As shown in FIG. 11, in the resin layers 244, 245, the blending ratio of the hard material and the soft material varies in three stages. The number of stages is the same as the number of the layers. Namely, the blending ratio of the hard material is 75% in the first layer, 55% in the second layer, and 35% in the third layer. As such, the more distant the layer is from the front head 220 or the rear head 250, the less the blending ratio of the hard material becomes. On the other hand, the blending ratio of the soft material is 25% in the first layer, 45% in the second layer, and 65% in the third layer. As such, the more distant the layer is from the front head 220 or the rear head 250, the more the blending ratio of the soft material becomes. In other words, the hardnesses L21 to L23 of the resin layers 244, 245 are such that, the more distant the layer is from the front head 220 or the rear head 250, the less the hardness becomes. Further, the difference in the hardness between adjacent two layers out of the resin layers 244, 245 is as follows. Namely, the hardness differential ΔL12 (=L21−L22) between the first layer and the second layer, the hardness differential ΔL23 (=L22−L23) between the second layer and the third layer, are all smaller than the hardness differential ΔL13 (=L21−L23) between hardness L23 of the third layer most distant from the base and the hardness L21 of the first layer closest to the base. In the present embodiment, the adhesive strength between the first layer and the second layer, and the adhesive strength between the second layer and the third layer are all greater than the adhesive strength between the first layer and the third layer in cases of forming the third layer on the surface of the first layer.

Further, the hardness of the third layer most distant from the base is smaller than that of the metal material constituting the piston 40. In the present embodiment, the hardness of each of the rest of two layers is also smaller than the hardness of the metal material constituting the piston 40. Further, the bend elastic constant of each layer constituting the resin layers 244, 245 is smaller than the Young's modulus of the metal material constituting the base of the front head 20, the base of the rear head 50, and the piston 40. Note that the "two members provided so as to sandwich the resin layer" are the base of the front head 20 and the piston 40 in cases of the resin layer 244 provided to the under surface of the front head 20, and are base of the rear head 50 and the piston 40 in cases of the resin layer 245 provided to the top surface of the rear head 50.

[Characteristics of Compressor of Second Embodiment]

As in First Embodiment, in the compressor of the present embodiment, the frictional loss is reduced and each of the resin layers 244, 245 is kept from separating from the base.

(Third Embodiment)

Next, the following describes Third Embodiment, according to the present invention. A compressor of the present embodiment is different from the compressor of the First Embodiment in that the resin layer 344 is provided on the outer circumference surface of the base 43 of the piston 40 (excluding the surface where the blade is attached), instead of providing the resin layers to the top surface or the under surface of the base 43 of the piston 40. Note that elements of the present, embodiment identical to those of First Embodiment are given the same reference numerals and details of those elements are omitted.

<Resin Layer>

Figure 15:
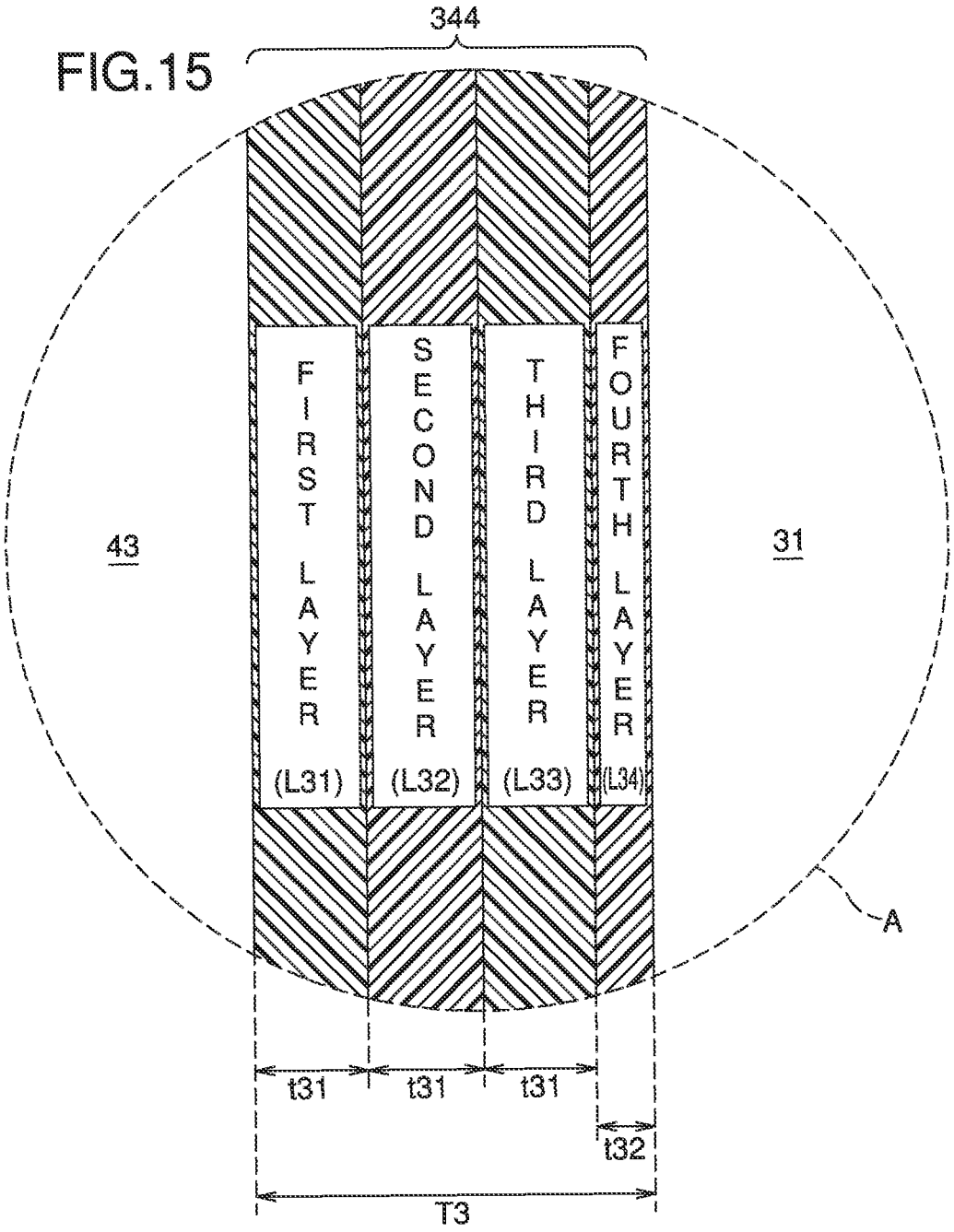
FIG. 15 is an enlarged view of an area circled by a broken line A in FIG. 14.

As shown in FIG. 15, the resin layer 344 is a stack of four layers, i.e., a first layer closest to the outer circumference surface of the base 43, and a second layer, third layer, and a fourth layer which are stacked in this order towards outside. That is, the fourth layer is most distant from the base 43. Further, the thickness t31 of each of the first layer to the third layer is the same, and the thickness t32 of the fourth layer is smaller than, the thickness t31 of each of the first layer to the third layer. Thus, the thickness t32 of the fourth layer is not more than 50% of the thickness T3(=3×t31+t32) of the entire resin layer 344. Further, as in the First Embodiment, in the resin layer 344, the second layer and the third layer are each a layer containing an anti-swelling agent which prevents the layer from swelling even when an oil or a refrigerant is absorbed. The first layer and the fourth layer on the other hand, do not contain the anti-swelling agent. Therefore, the second layer and the third layer are kept from swelling as compared with the first layer and the fourth layer. Note that, in FIG. 15, the reference numerals L31 to L34 shown in parenthesis in each layer of the resin layer 344 indicate the hardness of the first layer to the fourth layer, respectively. Further, the hardness of the second layer and that of the third layer are each hardness of portions of the layer other than the anti-swelling agent.

As in the resin layers 44*a*, 44*b* of First Embodiment, in the resin layer 344, the blending ratio (%) of the hard material and the soft material is varied, in four stages. The number of stages corresponds to the number of layers. In the resin, layer 344, the hardness differential of two adjacent layers is as follows. Namely, the hardness differential (=L31−L32) between the first layer and the second layer, the hardness differential (=L32−L33) between the second, layer and the third layer, the hardness differential (=L33−L34) between the third layer and the fourth layer are all smaller than the hardness differential (=L31−L34) between the hardness L34 of the fourth layer most distant from the base 43 and the hardness L31 of the first layer closest to the base 43. In the present embodiment, the adhesive strength between the first layer and the second layer, the adhesive strength between the second layer and the third layer, and the adhesive strength between the third layer and the fourth layer are all greater than the adhesive strength between the first layer and the fourth layer in cases of forming the fourth layer on the surface of the first layer.

Further, the hardness of the fourth layer most distant from the base 43 is smaller than the hardness of the metal material constituting the cylinder 30. In the present embodiment, the hardness of each of the rest of three layers is also smaller than the hardness of the metal material constituting the cylinder 30. Further, the bend elastic constant of each layer constituting the resin layer 344 is smaller than the Young's modulus of the metal material constituting the base 43 and the cylinder 30. Note that the "two members provided so as to sandwich the resin layer" are the base 43 and the cylinder 30.

[Characteristics of Compressor of Third Embodiment]

As in First Embodiment, in the compressor of the present embodiment, the frictional loss is reduced while the resin layer 344 is kept from separating from the base 43.

(Fourth Embodiment)

Next, the following describes Fourth Embodiment, according to the present invention. A compressor of the present embodiment is different, from, the compressor of First Embodiment in that a resin layer 444 is provided to the inner circumference surface of the cylinder 30 (excluding the refrigerant inlet hole, and opening of the blade storage groove), instead of providing a resin layer to the piston 40. Note that elements of the present embodiment identical to those of First Embodiment are given the same reference numerals and details of those elements are omitted.

<Resin Layer>

The resin layer 444 is a stack of three layers, i.e., a first layer closest to the inner circumference surface of the base of the cylinder 30, and a second layer and a third layer which are stacked in this order towards outside. In other words, the third layer is most distant from, the base of the cylinder 30. The second layer is disposed between the first layer and the third layer, and connects the first layer with the third layer. The thickness of the first layer and that of the second layer is the same, and the thickness of the third layer is smaller than those of the first layer and the second layer. The thickness of the third layer is not more than 50% of the thickness of the resin, layer 444. Further, as in First Embodiment, in resin layer 444, the second layer contains an anti-swelling agent which keeps the layer from absorbing an oil and a refrigerant, and the first layer and the third layer do not contain the anti-swelling agent. Therefore, the second layer is kept from swelling as compared with the first layer and the third layer.

As in the case of the resin layers 244, 245 of Second Embodiment, in the resin layer 444, the blending ratio (%) of the hard, material and the soft material is varied in three stages. The number of stages corresponds to the number of layers. In the resin layer 444, the hardness differential between two adjacent layers is as follows. Namely, the hardness differential between the first layer and the second layer, the hardness differential between the second layer and the third layer are all smaller than the hardness differential between the hardness of the third layer most distant from the base and the first layer closest to the base. In the present embodiment, the adhesive strength between the first layer and the second layer, and the adhesive strength between the second layer and the third layer are both stronger than the adhesive strength between the first layer and the third layer in cases of forming the third layer to the surface of the first layer.

Further, the hardness of the third layer most distant from the base is smaller than the hardness of the metal material constituting the piston 40. Note that, in the present embodiment, the hardness of each of the rest of two layers is also smaller than the hardness of the metal material constituting the piston 40. Further, the bend elastic constant of each layer constituting the resin layer 444 is smaller than the Young's modulus of the metal material constituting the base of the cylinder 30 and the piston 40. Note that the "two members provided so as to sandwich the resin layer" are the base of the cylinder 30 and the piston 40.

[Characteristics of Compressor of Fourth Embodiment]

As in First Embodiment, in a compressor of the present, embodiment, the frictional loss is reduced while the resin layer 444 is kept from separating from the base.

(Fifth Embodiment)

Figure 17:
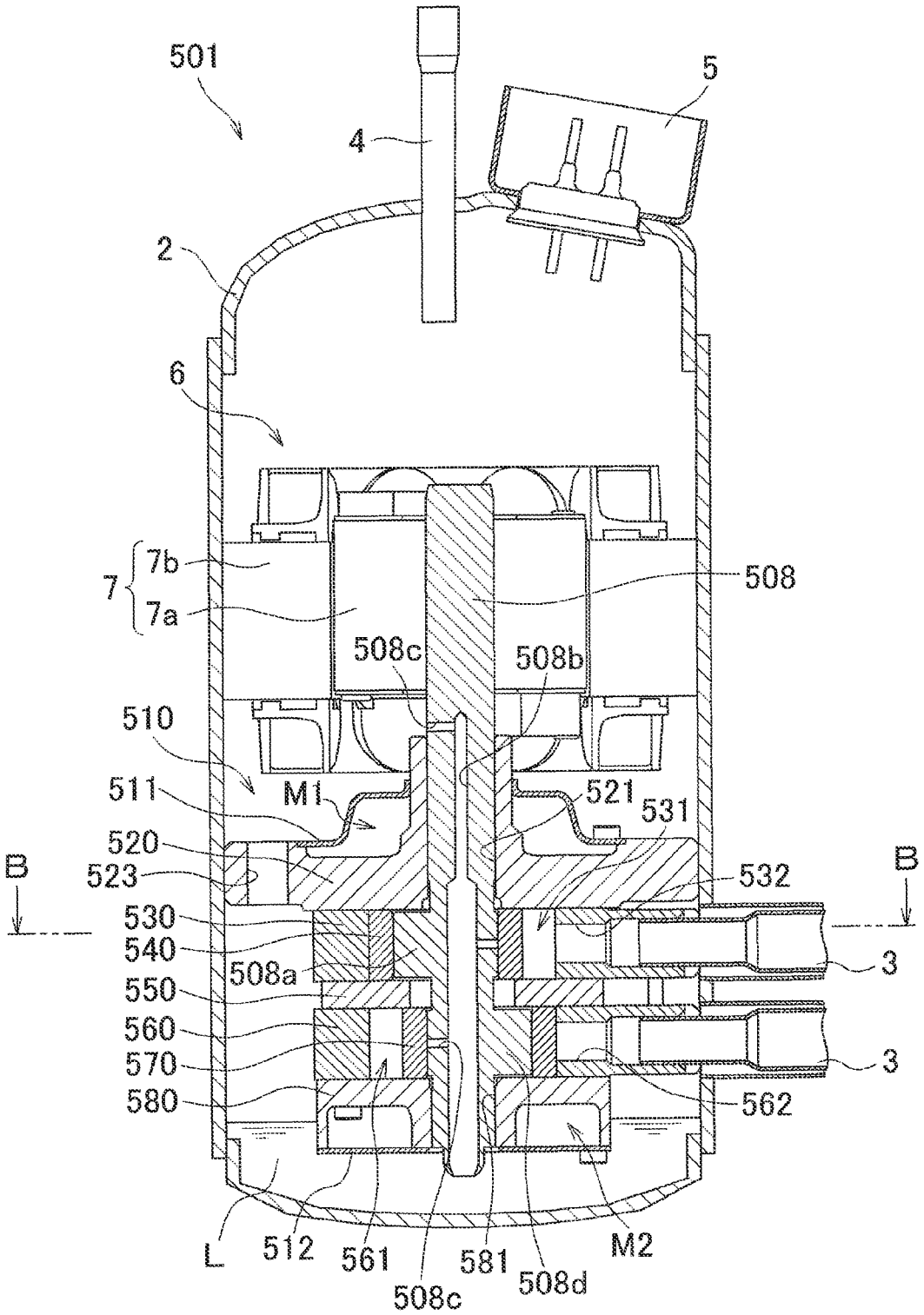
FIG. 17 is a schematic cross sectional view of the compressor related to Fifth Embodiment, according to the present invention.

The following describes Fifth Embodiment, according to the present invention. The present embodiment is an exemplary application of the present invention to a dual-cylinder rotary compressor. As shown in FIG. 17, a compressor 501 of the present embodiment is different from First. Embodiment in the structures of the shaft 508 and the compressing structure 510. Further, the compressor 501 of the present embodiment has two inlet pipe fittings 3 on a side of the closed casing 2, aligned in the vertical direction. The structure other than the above is the same as that of First Embodiment. Therefore, the same reference numerals are given and the explanations are omitted as needed.

The shaft 508 has two eccentric portions 508*a*, 508*d*. The shaft centers of the two eccentric portions 508*a*, 508*a* are shifted from, each other by 180° about the rotational axis of the shaft 508. Further, as in the shaft 8 of First Embodiment, the shaft 508 has a lubrication path 508*b* and a plurality of outlet holes 508*c*.

The compressing structure 510 sequentially has, from, the top to the bottom along the axial direction of the shaft 508, a front muffler 511, a front head 520, a cylinder 530, a piston 540, a middle plate 550, a cylinder 560, piston 570, a rear head 580, and a rear muffler 512. The front head 520 and the middle plate 550 are disposed at the upper and lower ends of the piston 540, and correspond to the first end plate member and the second end plate member of the present invention, respectively. Further, the middle plate 550 and the rear head 580 are disposed at the upper and lower ends of the piston 570, and correspond to the first end plate member and the second end plate member of the present invention, respectively.

The front muffler 511 has a structure similar to that of the muffler 11 of First Embodiment, and forms a muffler space M1 between the muffler 511 and the front head 520.

To the front head 520 are formed a bearing hole 521, a discharge hole 522 (see FIG. 18), and an oil-returning hole 523. Further, the front head 520 has a through hole (not shown) penetrating the front head 520 in the vertical direction. The through hole constitute a part of the passage for discharging a refrigerant in the muffler space M2 formed by the rear head 580 and the rear muffler 512 to the muffler space M1. The structure of the front head 520 other than this through hole is the same as that of the front head 20 of First Embodiment.

Figure 18:
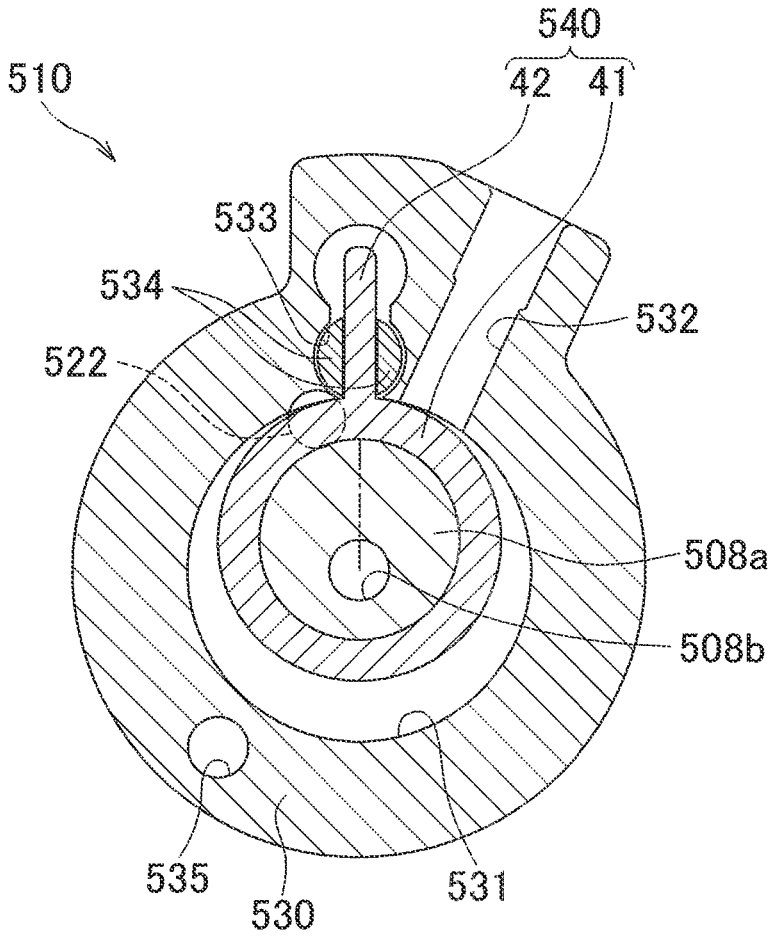
FIG. 18 is a cross sectional view taken along the line B-B in 17.
Figure 19A:
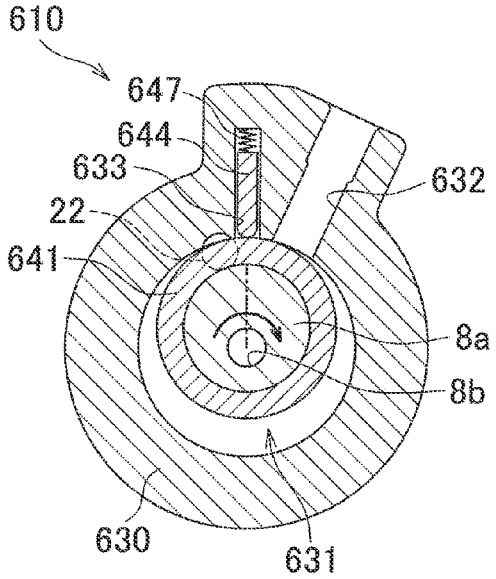
FIG. 19 is a diagram showing an operation of a roller and vane in a cylinder of a compressor related to Sixth Embodiment, according to the present invention.
Figure 19B:
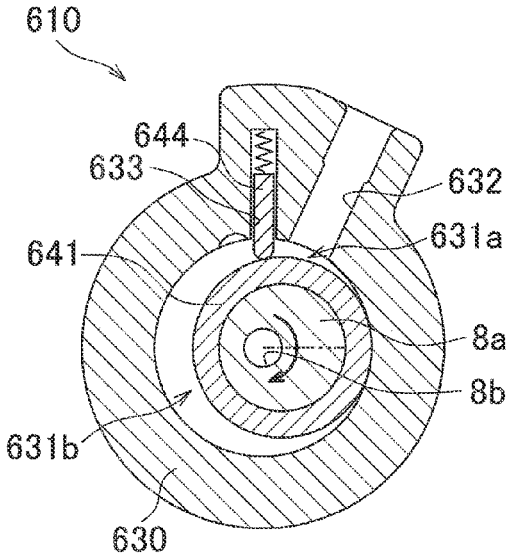
Figure 19C:
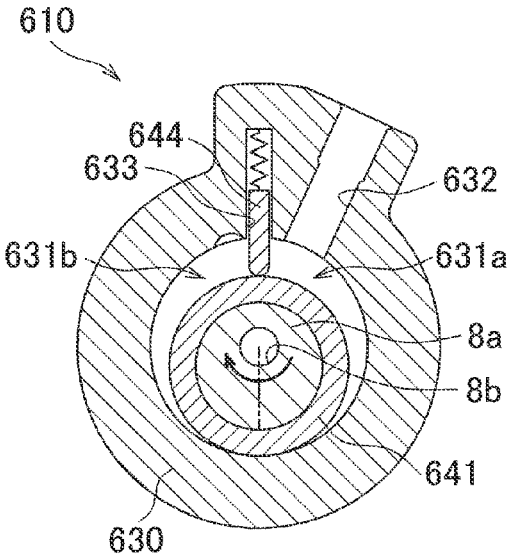
Figure 19D:
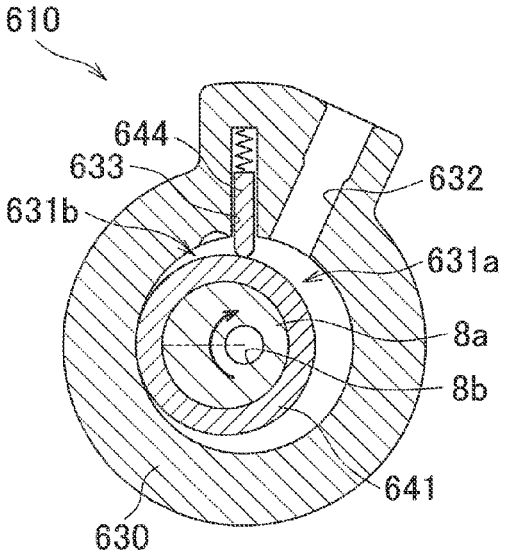

As shown in FIG. 18, in the cylinder 530 are formed a compression chamber 531, a draw-in hole 532, and a blade housing 533. Further, the cylinder 530 has a through hole 535 formed at its outer circumference-side portion of the compression chamber 531. The through hole 535 is for discharging the refrigerant in the later-mentioned muffler space M2 to the muffler space M1. The structure of the cylinder 530 other than this through hole 535 is the same as that of the cylinder 30 of First Embodiment.

The structure of the piston 540 is similar to that of the piston 40 of First Embodiment, and includes a roller 41 and a blade 42. The roller 41 is rotatably mounted to the outer circumference surface of the eccentric portion 508*a*. The blade 42 is disposed between a pair of bushes 34 in the blade housing 533 of the cylinder 530 and is capable of moving forward and backward.

The middle plate 550 is an annular plate member which is disposed between the cylinder 530 and the cylinder 560, and closes the lower end of the compression chamber 531 of the cylinder 530 while closing the upper end of the compression chamber 531 of the cylinder 560. Further, the middle plate 550 has a through hole (not shown) for discharging the refrigerant in the later-mentioned muffler space M2 to the muffler space M1. The middle plate 550 is made of a metal material and example manufacturing methods include sintering of metal powder, casting, cutting, or the like.

The structure of the cylinder 560 is similar to that of the cylinder 530, and includes a compression chamber 561, a draw-in hole 562, a blade housing (not shown) in which the pair of bushes 34 are disposed, and a through hole (not shown).

The structure of the piston 570 is similar to that of the piston 40 of First Embodiment and includes the roller 41 and the blade 42. The roller 41 is rotatably mounted to the outer circumference surface of the eccentric portion 508*d*. The blade 42 is disposed between a pair of bushes 34 in the blade housing (not shown) of the cylinder 560 and is capable of moving forward and backward.

The rear head 580 is disposed on the lower side of the cylinder 560 and closes the lower end of the compression chamber 531 of the cylinder 560. The rear head 580 is a substantially annular member, and its center portion has a bearing hole 581 into which the shaft 508 is rotatably inserted. Further, to the rear head 580 is formed a discharge hole (not shown) for discharging the refrigerant compressed in the compression chamber 561 of the cylinder 560 to the muffler space M2 formed between the rear head 580 and the rear muffler 512. Further, to the rear head 580 is formed a through hole (not shown) for discharging the refrigerant in the muffler space M2 to the muffler space M1. On the under surface of the rear head 580 is provided a valve structure (not shown) which opens and closes the discharge hole according to the pressure in the compression chamber 531. The rear head 580 is made of a metal material and example manufacturing methods include sintering of metal powder, casting, cutting, or the like.

The rear muffler 512 is provided for reducing the noise generated when the refrigerant is ejected from the discharge hole (not shown) from the rear head 580. The rear muffler 512 is attached to the under surface of the rear head 580 by using a bolt and forms the muffler space M2 between the rear muffler 512 and the rear head 580. The muffler space M2 is in communication with the muffler space M1 through the through holes of the rear head 580, the cylinder 560, the middle plate 550, the cylinder 530, and the front head 520.

<Resin Layer>

Figure 12:
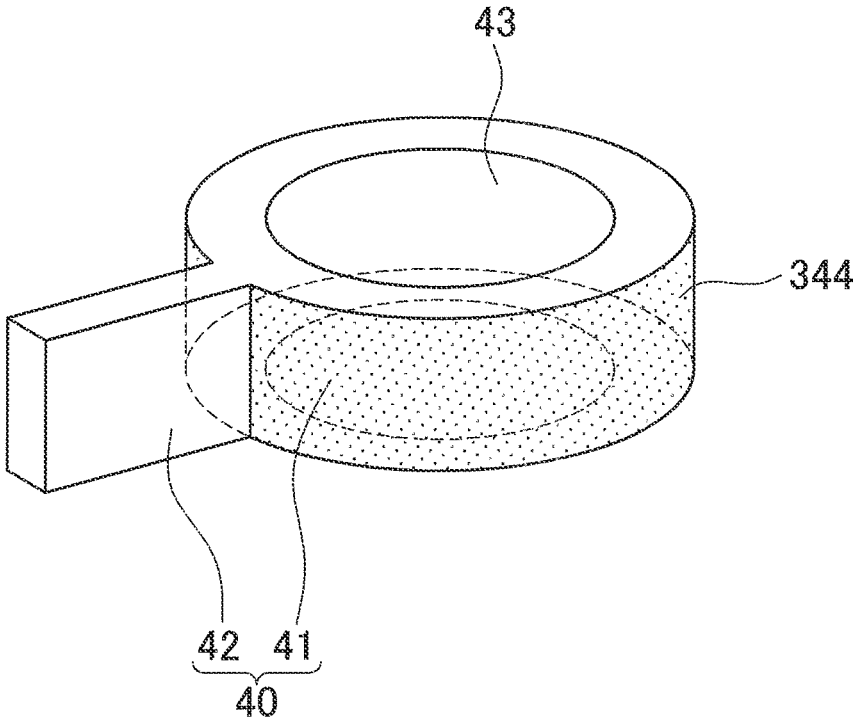
FIG. 12 is a perspective diagram of a piston in the compressor related to Third Embodiment, according to the present invention.
Figure 13:
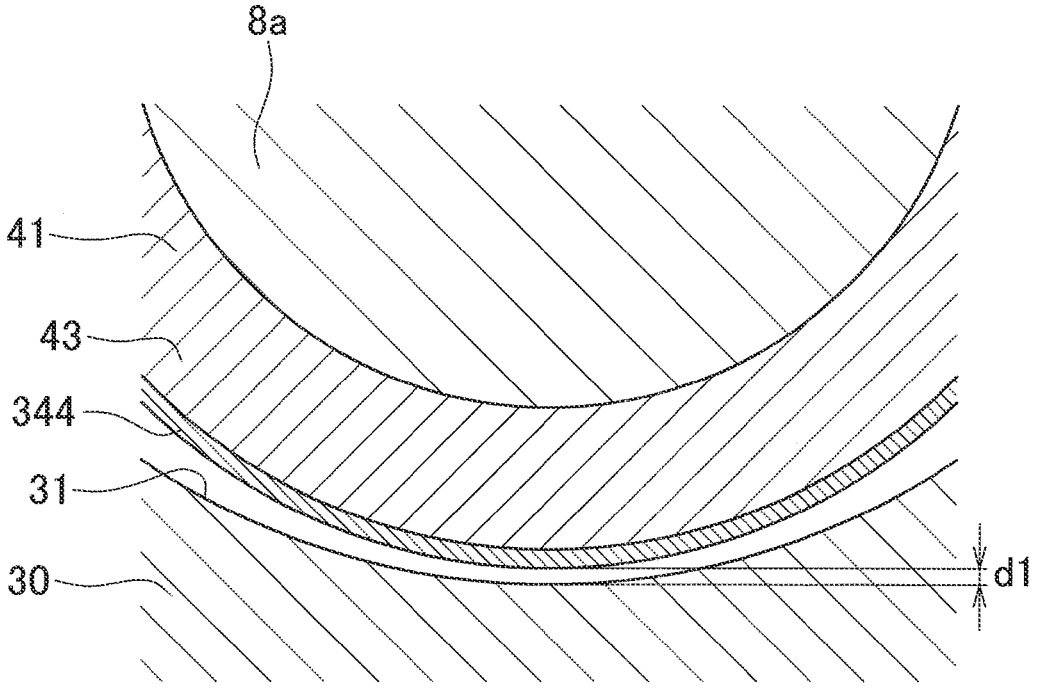
FIG. 13 is a partially enlarged view of a compressing structure.
Figure 14A:
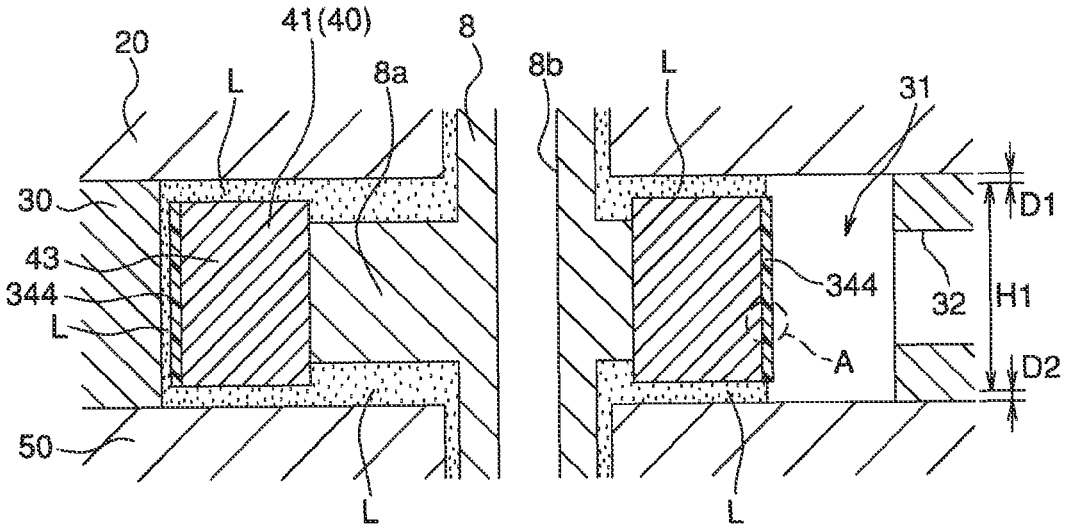
FIG. 14 is a diagram schematically showing a partially enlarged view of the compressing structure of Third Embodiment, according to the present invention, wherein FIG. 14(*a*) shows a state where the resin layer is not swollen, and FIG. 14(*b*) shows a state where the resin layer is swollen.
Figure 14B:
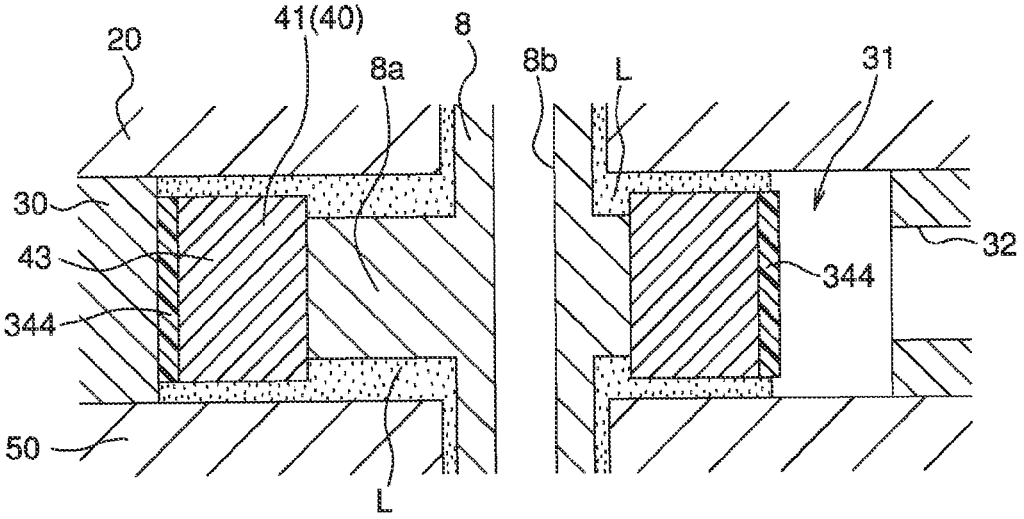
Figure 16:
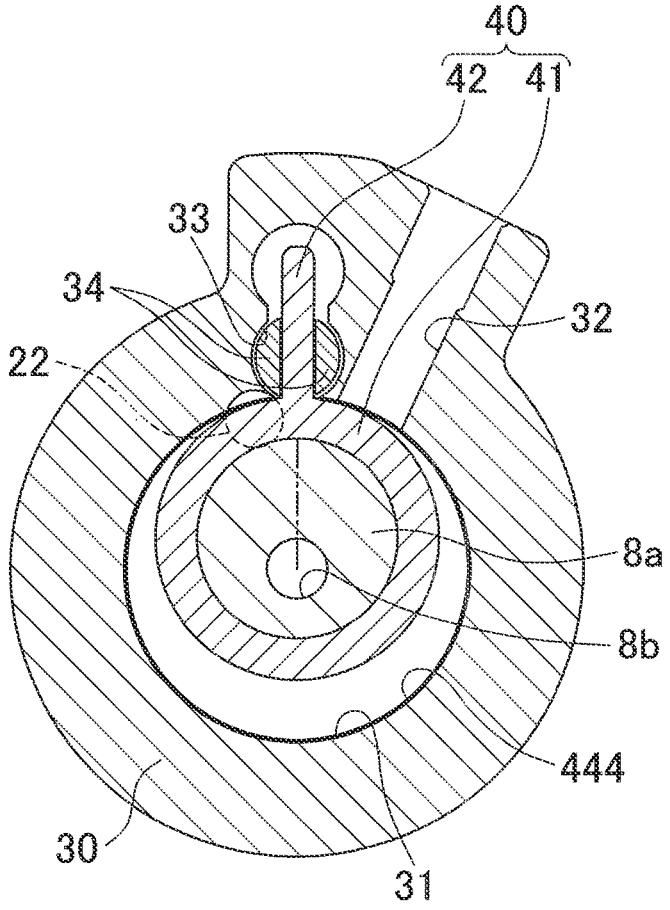
FIG. 16 is a cross sectional view of a cylinder and a piston in the compressor, related to Fourth Embodiment, according to the present invention.

In the compressor of the present embodiment, resin layers 44*a*, 44*b* (see FIG. 4) similar to those of First Embodiment may be formed in a whole area or in a part of the upper end surface and the lower end surface of the piston 540, 570. Further, resin layers 244, 245 (see FIG. 8, FIG. 9) similar to those in Second Embodiment may be formed in a whole area or in a part of the lower end surface of the front head 520, the upper and lower end surfaces of the middle plate 550, and the upper end surface of the rear head 580. Further, a resin layer 344 (see FIG. 12 to FIG. 14) similar to that in Third Embodiment may be formed in a whole area or in a part of the outer circumference surface of the roller 41 of the pistons 540, 570. Further, a resin layer 444 (see FIG. 16) similar to that in. Fourth Embodiment may be formed in a whole area or in a part of the inner circumference surface of the cylinders 530, 560.

<Operation of Compressor>

The following describes an operation of the compressor 501 of the present embodiment. When the motor 7 is driven to rotate the shaft 508, while supplying the refrigerant from the draw-in holes 532, 562 to the compression chambers 531, 561, the roller 41 of the piston 540 mounted to the eccentric portion 508*a* moves along the circumferential wall of the compression chamber 531. This compresses the refrigerant in the compression chamber 531. Meanwhile, the roller 41 on the piston 570 mounted to the eccentric portion 508*d* moves along the circumferential wall of the compression chamber 561. This compresses the refrigerant in the compression chamber 561.

When the pressure inside the compression chamber 531 reaches a predetermined pressure or higher, the valve structure provided to the front head 520 opens and the refrigerant in the compression chamber 531 is ejected to the muffler space M1 from the discharge hole 22 on the front head 520. Further, when the pressure inside the compression chamber 561 reaches a predetermined pressure or higher, the valve structure provided to the rear head 580 opens and the refrigerant in the compression chamber 561 is ejected to the muffler space M2 from the discharge hole (not shown) on the rear head 580. The refrigerant ejected to the muffler space M2 is then ejected to the muffler space M1 through the through holes of the rear head 580, the cylinder 560, the middle plate 550, the cylinder 530, and the front head 520.

The refrigerant ejected, to the muffler space M1 is ejected, outside the compressing structure 510 from the muffler discharge hole (not shown) of the front muffler 511, passes the air gap between the stator 7*b* and the rotor 7*a*, and then discharged from the outlet pipe fitting 4 to outside the closed casing 2.

[Characteristics of Compressor of Fifth Embodiment]

As in First Embodiment, in the compressor of the present embodiment, the frictional loss is reduced while the resin layer is kept from separating from the base.

(Sixth Embodiment)

Next, the following describes a. Sixth Embodiment of the present invention. A compressor of the present embodiment is different from First Embodiment in the structure of its compressing structure 610. The structure other than the above is the same as that of First Embodiment. Therefore, the same reference numerals are given and the explanations are omitted as needed.

As shown in FIG. 19, the compressing structure 610 is different from the cylinder 630 in its structure of the members arranged inside the cylinder 630; however, the structures other than that are the same as those of First Embodiment.

The cylinder 630 has a compression chamber 631 and a draw-in hole 632. Further, the cylinder 630 has a vane housing 633 in place of the blade housing 33 of First Embodiment, and the structures other than that are the same as those of the cylinder 30 of First Embodiment. The vane housing 633 penetrates the cylinder 630 in the vertical direction, and is in communication with the compression chamber 631. Further, the vane housing 633 extends in a radial direction of the compression chamber 631.

Inside the compression chamber 631 is an annular roller 641. The roller 641 is disposed inside the compression chamber 631 and is mounted to the outer circumference surface of the eccentric portion 8*a* so that relative rotation is possible. The vertical length of the roller 641 is the same as the vertical length H1 of the piston 40 of First Embodiment. Further, the external diameter of the roller 641 is the same as that of the roller 41 of the piston 40 of First Embodiment.

Figure 20:
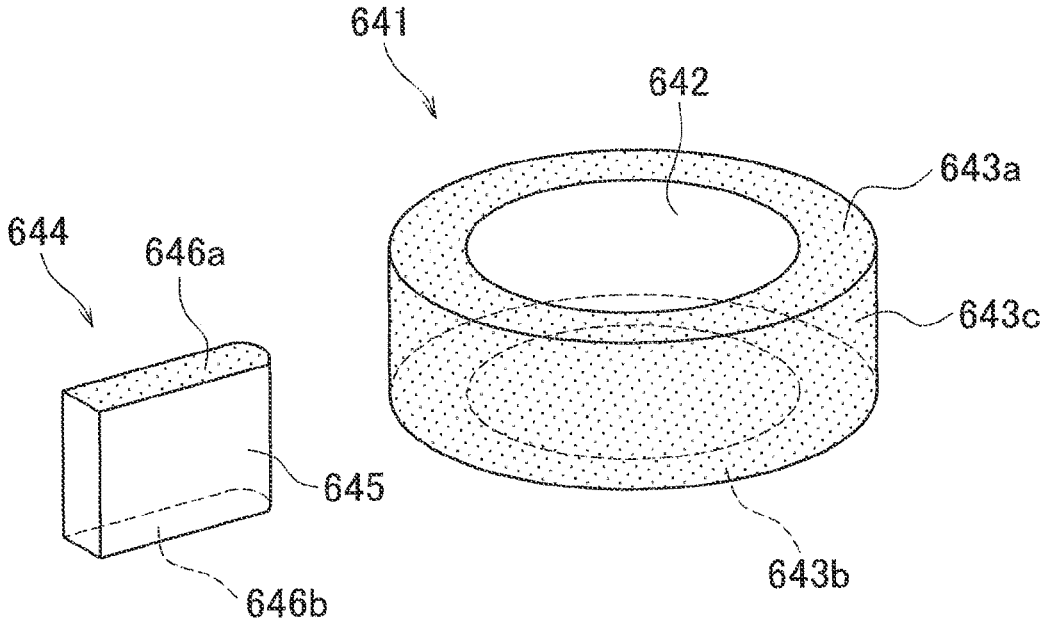
FIG. 20 is a perspective diagram of a piston.

Inside the vane housing 633 is disposed a vane 644. As shown in FIG. 20, the vane 644 is a flat plate member and its vertical length is the same as the vertical length of the roller 641.

The leading end portion of the vane 644, which is an end on the side closer to the center of the compression chamber 631 (the leading end portion on the lower side in FIG. 19), has a tapered shape when viewed, from the top. Further, the vane 644 is biased by a biasing spring 647 provided inside the vane housing 633, and the leading end portion on the side of the compression chamber 631 is pressed against the outer circumference surface of the roller 641. Therefore, as shown in FIG. 19(*a*) to FIG. 19(*d*), when the roller 641 moves along the circumferential wall of the compression chamber 631 with rotation of the shaft 8, the vane 644 moves forward and backward in a radial direction of the compression chamber 631 within the vane housing 633. Further, as shown in FIG. 19(*b*) to FIG. 19(*d*), when the vane 644 sticks out from the vane housing 633 towards the compression chamber 631, the space formed between the outer circumference surface of the roller 641 and the circumferential wall of the compression chamber 631 is divided into a low pressure chamber 631*a* and the high pressure chamber 631*b* by the vane 644.

Figure 21A:
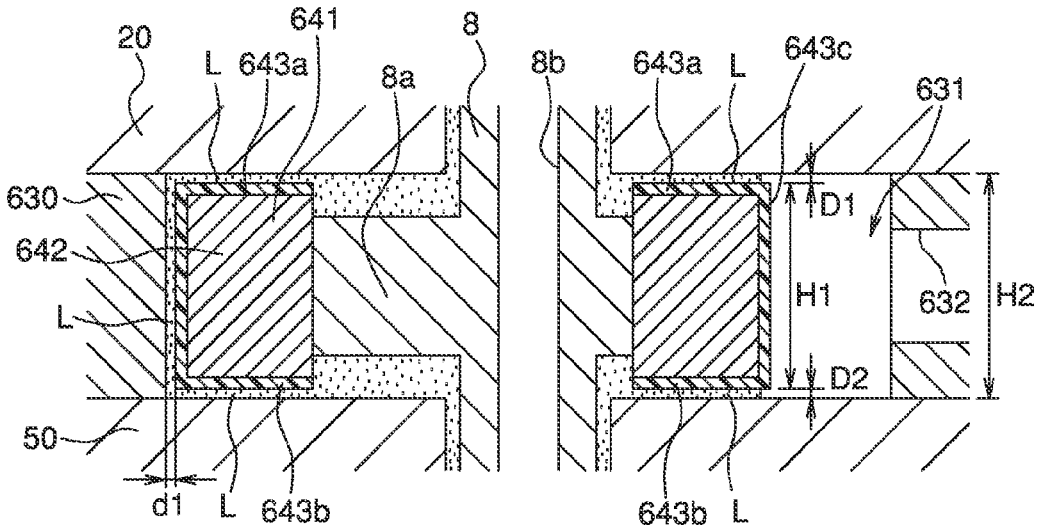
FIG. 21 is a diagram schematically showing a partially enlarged view of the compressing structure, wherein FIG. 21(*a*) shows a state where a resin layer is not swollen, and FIG. 21(*b*) shows a state where the resin layer is swollen.
Figure 21B:
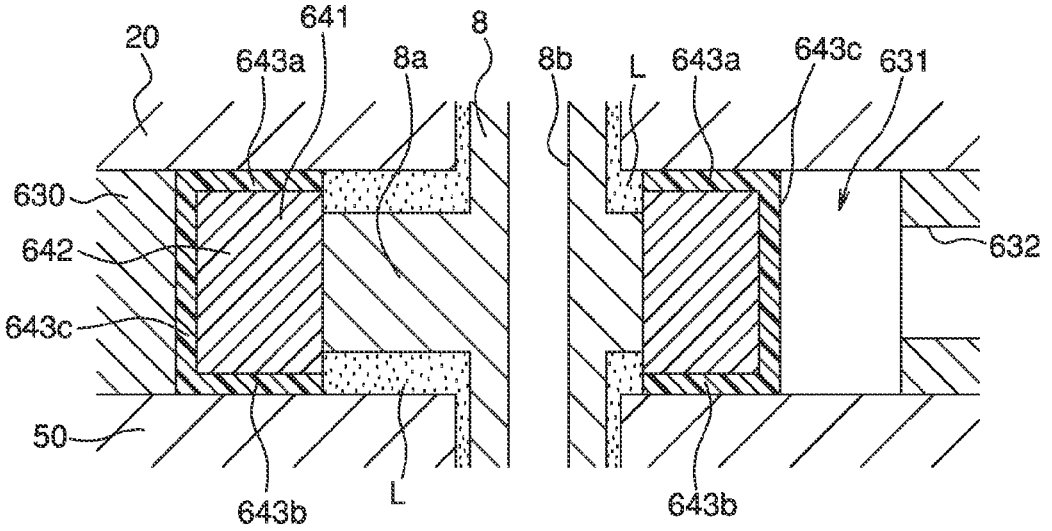

As shown in FIG. 20 and FIG. 21, the roller 641 includes a base 642 made of a metal material, and resin layers 643*a* to 643*c* which are thin films coating the surfaces of the base 642. Further, the vane 644 includes a base 645 made of a metal material, and resin layers 646*a*, 646*b* which are thin films coating the surfaces of the base 645.

As shown in FIG. 20, the bases 642, 645 have a shape similar to the shapes of the roller 641 and the vane 644. The bases 642, 645 are made by sintering metal powder, casting, or cutting, and their surfaces are polished.

<Resin Layers>

The resin layers 643*a*, 643*b* of the roller 641 coats the top surface and the under surface of the base 642, respectively. In other words, the resin layers 643*a*, 643*b* are formed on the upper and lower end surfaces of the roller 641, respectively. Further, the resin layer 643*c* is formed on the outer circumference surface of the roller 641. Further, the resin layers 646*a*, 646*b* of the vane 644 are formed on the top surface and the under surface of the base 645, respectively. In other words, the resin layers 646*a*, 646*b* are formed on the upper and lower end surfaces of the vane 644. The material and the film thickness of the resin layers 643*a* to 643*c*, 646, 646*b* are the same as those of the resin layers 44*a*, 44*b* on the piston 40 of First Embodiment.

<Operation of Compressor>

Next, the following describes an operation of the compressor of the present embodiment. The FIG. 19(*a*) shows that the roller 641 is at the upper dead center, and FIG. 19 (*b*) to FIG. 19(*d*) shows states where the shaft 8 rotates by 90°, 180° (lower dead center), and 270° from the state of FIG. 19(*a*), respectively.

when the motor 7 is driven to rotate the shaft 8, while the refrigerant is supplied from the inlet pipe fitting 3 to the compression chamber 631 through the draw-in hole 632, the roller 641 mounted to the eccentric portion 8*a* moves along the circumferential wall of the compression chamber 631, as shown in FIG. 19(*a*) to FIG. 19(*d*). This compresses the refrigerant in the compression chamber 631. The following details the process in which the refrigerant is compressed.

When the eccentric portion 8*a* rotates in the direction shown by the arrow in the figure from the state shown in FIG. 19(*a*), the space formed between the outer circumference surface of the roller 641 and the circumferential wall of the compression chamber 631 is divided into a low pressure chamber 631*a* and a high pressure chamber 631*b*, as shown in FIG. 19(*b*). When the eccentric portion 8*a* further rotates, the volume of the low pressure chamber 631*a* increases as shown in FIG. 19(*b*) to FIG. 19(*d*). Therefore, the refrigerant is drawn into the low pressure chamber 631*a* from the inlet pipe fitting 3 through the draw-in hole 632. At the same time, the volume of the high pressure chamber 631*b* is reduced. Therefore, the refrigerant in the high pressure chamber 631*b* is compressed.

Then, when the pressure inside the high pressure chamber 631*b* reaches a predetermined pressure or higher, the valve structure provided to the front head 20 is opened and the refrigerant in the high pressure chamber 631*b* is ejected to the muffler space M from the discharge hole 22. The refrigerant ejected to the muffler space M flows the path similar to the compressor 1 of First Embodiment, and at the end, is discharged from the outlet pipe fitting 4 to the outside the closed casing 2.

[Characteristics of Compressor of Sixth Embodiment]

As in First Embodiment, in the compressor of the present embodiment, the frictional loss is reduced while the resin layer is kept from separating from the base.

<Seventh Embodiment>

Figure 22:
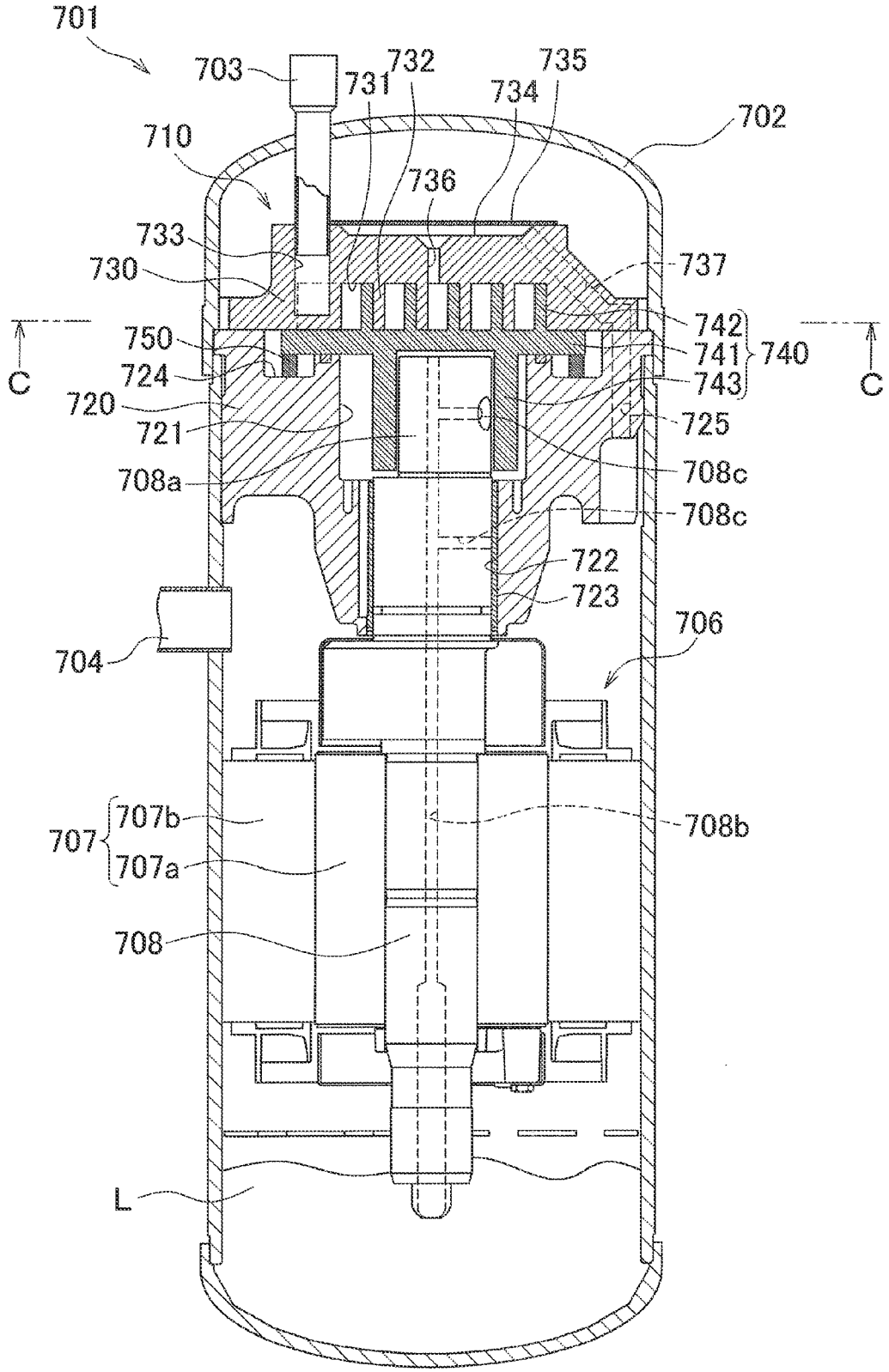
FIG. 22 is a schematic cross sectional view of a compressor related to Seventh Embodiment, according to the present invention.
Figure 23A:
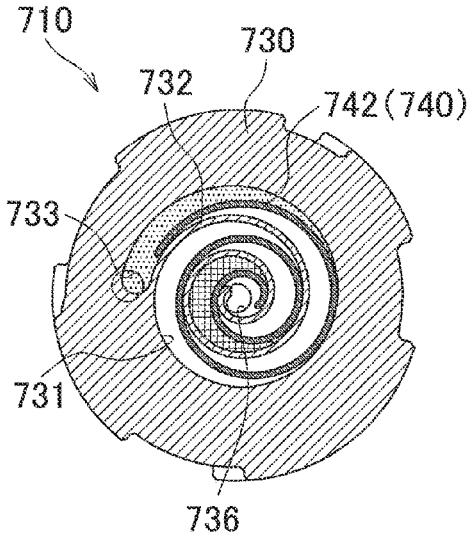
FIG. 23 is a cross sectional view of a line C-C in FIG. 22, and shows an operation a moveable scroll.
Figure 23B:
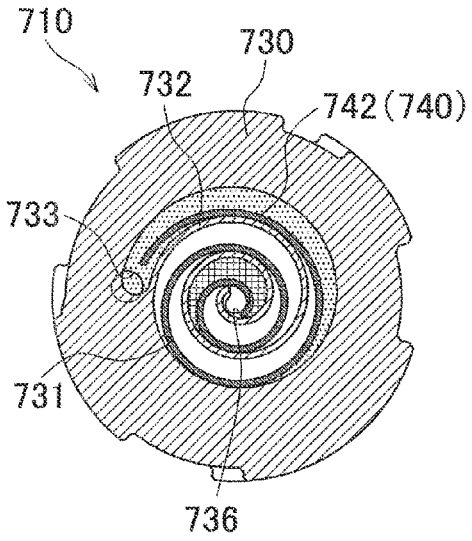
Figure 23C:
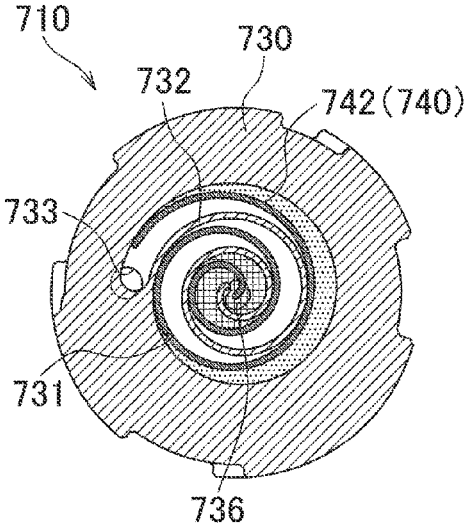
Figure 23D:
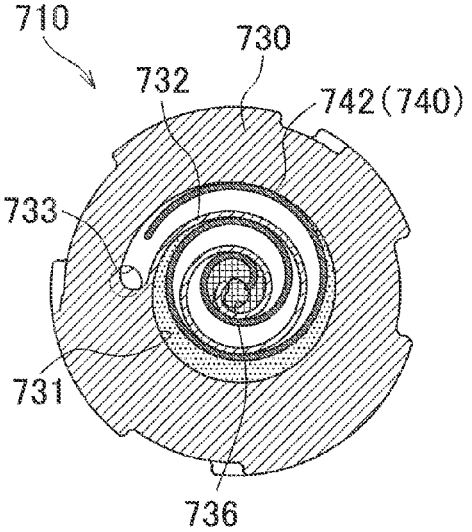

Next, the following describes a Seventh embodiment of the present invention. The present embodiment is an exemplary application of the present invention to a scroll compressor. As shown in FIG. 22, a compressor 701 of the present embodiment includes a closed casing 702, a compressing structure 710 disposed inside the closed casing 702, and the drive mechanism 706. FIG. 22 omits hatching that indicates the cross section of the drive mechanism 706. The following description of the compressor 701 assumes that the up/down direction of the FIG. 22 is the vertical direction.

The closed casing 702 is a cylindrical container with its both ends closed. On top of the closed casing 702 is provided an inlet pipe fitting 703 for introducing the refrigerant. On a side of the closed casing 702 is provided an outlet pipe fitting 704 for discharging the compressed refrigerant, and a terminal (not shown) for supplying electricity to the coil of a later-mentioned stator 707*b* in the drive mechanism 706. Further, at the bottom in the closed casing 702 is stored a lubricating oil L for smoothening the operation of the slide portion in the compressing structure 710. Inside the closed casing 702, the compressing structure 710 and the drive mechanism 706 are disposed, aligned in the vertical direction.

The drive mechanism 706 includes a motor 707 serving as a drive source, and a shaft 708 attached to this motor 707. In other words, it includes the motor 707 and the shaft 708 for transmitting the drive force of the motor 707 to the compressing structure 710.

The structure of the motor 707 is substantially the same as that of the motor 7 of First Embodiment, and includes a substantially annular stator 707*b* which is fixed to the inner circumference surface of the closed casing 702, and a rotor 707*a* disposed on the radially inner side of the stator 707*b* with an air gap therebetween. Further, the outer circumference surface of the stator 707*b* is not entirely in close contact with the inner circumference surface of the closed casing 702, i.e., a plurality of recesses (not shown) extending in the vertical direction and communicating the spaces above and below the motor 707 are provided along the outer circumference surface of the stator 707*b*.

The shaft 708 is for transmitting the drive force of the motor 707 to the compressing structure 710, and is fixed to the inner circumference surface of the rotor 707*a* to rotate integrally with the rotor 707*a*. The shaft 708 has at its upper end portion an eccentric portion 708*a*. This eccentric portion 708*a* has a cylindrical shape and its shaft center is deviated from, the rotational center of the shaft 708. To this eccentric portion 708*a* is mounted a later-mentioned bearing portion 743 of the moveable scroll 740.

Further, in the shaft 708 is formed a lubrication path 708*b* which penetrates the shaft 708 in the vertical direction. At the lower end portion of this lubrication path 708*b* is a pump member (not shown) for drawing in the lubricating oil L into the lubrication path 708*b* with rotation of the shaft 708.

Further, the shaft 708 has a plurality of outlet holes 708*c* for discharging the lubricating oil L in the lubrication path 708*b* to the outside the shaft 708.

The compressing structure 710 includes a housing 720 fixed to the inner circumference surface of the closed casing 702, a fixed scroll (first scroll) 730 disposed on top of the housing 720, a moveable scroll (second scroll) 740 disposed between the housing 720 and the fixed, scroll 730.

The housing 720 is a substantially annular member, and is press fit and fixed to the closed, casing 702. The entire outer circumference surface of the housing 720 is closely attached to the inner circumference surface of the closed casing 702. At the center portion of the housing 720 are formed an eccentric portion storage hole 721 and a bearing hole 722 whose diameter is smaller than the eccentric portion storage hole 721. The eccentric portion storage hole 721 and the bearing hole 722 are aligned in the vertical direction. Inside the eccentric portion storage hole 721, the eccentric portion 708*a* of the shaft 708 is stored while being inserted inside the bearing portion 743 of the moveable scroll 740. The bearing hole 722 supports the shaft 708 so as to enable relative rotation of the shaft 708 through the bearing 723. Further, an annular groove 724 is formed on the top surface of the housing 720, on the outer circumference-side of the eccentric portion storage hole 721. Further, on the outer circumference of the annular groove 724 is a communication hole 725 penetrating the housing 720 in the vertical direction.

As shown in FIG. 22 and FIG. 23, the fixed scroll 730 is a substantially disc-like member, whose outer circumference-side portion of the under surface is fixed to the housing 720 by using a bolt (not shown) so as to closely contact the top surface of the housing 720. At the center portion on the under surface of the fixed scroll 730 is formed a substantially circular recess 731. Further, on the bottom surface (ceiling surface) of the recess 731 is formed a fixed-side wrap (first wrap) 732 having a spiral shape, which project downwards. The under surface (excluding the bottom surface of the recess 731) of the fixed scroll 730 and the leading end surface of the fixed-side wrap 732 are substantially flush with each other. Further, as shown in FIG. 23, the end portion (winding-end end portion) of the fixed-side wrap 732, on the outer circumference-side is connected to the circumferential wall of the recess 731.

Further, as shown in FIG. 22, the fixed scroll 730 has a draw-in path 733 extended from the top surface to the vicinity of the under surface of the fixed scroll 730. The draw-in path 733 is for introducing a refrigerant into the recess 731. At the upper end of the draw-in path 733 is inserted an inlet pipe fitting 703. As shown in FIG. 23, the lower end of this draw-in path 733 is formed on the bottom surface of the recess 731, where the radius of the recess 731 is the largest.

At substantially the center portion of the top surface of the fixed scroll 730, a recess 734 is formed, and a cover member 735 is attached to the fixed scroll 730 so as to cover the recess 734. Further, at the bottom surface of the recess 734 is formed a discharge hole 73 6 extended downward and in communication with the recess 731. The lower end of the discharge hole 736 is formed at substantially the center portion of the bottom surface of the recess 731. Further, on the fixed scroll 730 is formed a communication hole 737 which communicates a space surrounded by the recess 734 and the cover member 735 with the communication hole 725 formed on the housing 720. Note that FIG. 23 omits illustration of the bolt hole formed on the fixed scroll 730, and a later-mentioned communication hole 737. Further, the fixed scroll 730 is made of a metal material, and example manufacturing methods include sintering metal powder, casting, cutting, or the like.

The moveable scroll 740 includes a disc-like flat plate section 741, a spiral moveable-side wrap 742 projecting upward from the top surface of the flat plate section 741, and a cylindrical bearing portion 743 which projects downwards from the under surface of the fiat plate section 741. Inside the bearing portion 743 is inserted the eccentric portion 708*a* so that relative rotation is possible.

The flat plate section 741 is sandwiched by the under surface of the fixed scroll 730 and the upper end of the peripheral wall section of the eccentric portion storage hole 721. Further, the flat plate section 741 is supported by the housing 720 through the Oldham ring 750 disposed in the annular groove 724. The Oldham ring 750 is for preventing the rotation movement of the moveable scroll 740, and has sub-protrusions (not shown) on its top and under surfaces. The sub-protrusions engage with linear grooves (not shown) formed on the housing 720 and the moveable scroll 740 and which extend in a direction perpendicular to each other. This way the Oldham ring 750 is able to move relatively to the housing 720 and the moveable scroll 740 (i.e., two directions perpendicular to each other). Therefore, the moveable scroll 740 is moveable in horizontal directions with respect to the housing 720, while keeping its orientation (angle) constant. With the flat plate section 741 supported by the housing 720 through the Oldham ring 750 and with the eccentric portion 708*a* inserted into the bearing portion 743 so that relative rotation is possible, rotation of eccentric portion 708*a* (shaft 708) causes the moveable scroll 740 to move (circle) about the rotational axis of the shaft 708, without rotating about the center of the moveable scroll 740.

Further, the flat plate section 741 has a small hole (not shown) which guides the compressed refrigerant in the recess 731 to the eccentric portion storage hole 721 of the housing 720. Thus, during the operation of the compressor 701, the flat plate section 741 receives an upward force from the high-pressure refrigerant in the eccentric portion storage hole 721, and the top surface of the flat plate section 741 is pressed against the under surface of the fixed scroll 730. This prevents the high-pressure refrigerant in the recess 731 from pressing the moveable scroll 740 downward, increasing later-mentioned axial directional gaps D3, D4.

Further, as shown in FIG. 23, the moveable-side wrap 742 of the moveable scroll 740 is substantially symmetrical to the fixed-side wrap 732 of the fixed scroll 730, and is disposed on the flat plate section 741 so as to engage with the fixed-side wrap 732. Thus, a plurality of substantially crescent spaces are formed between the side surface of the fixed-side wrap 732 and the circumferential wall of the recess 731 and the side surface of the moveable-side wrap 742.

Figure 24A:
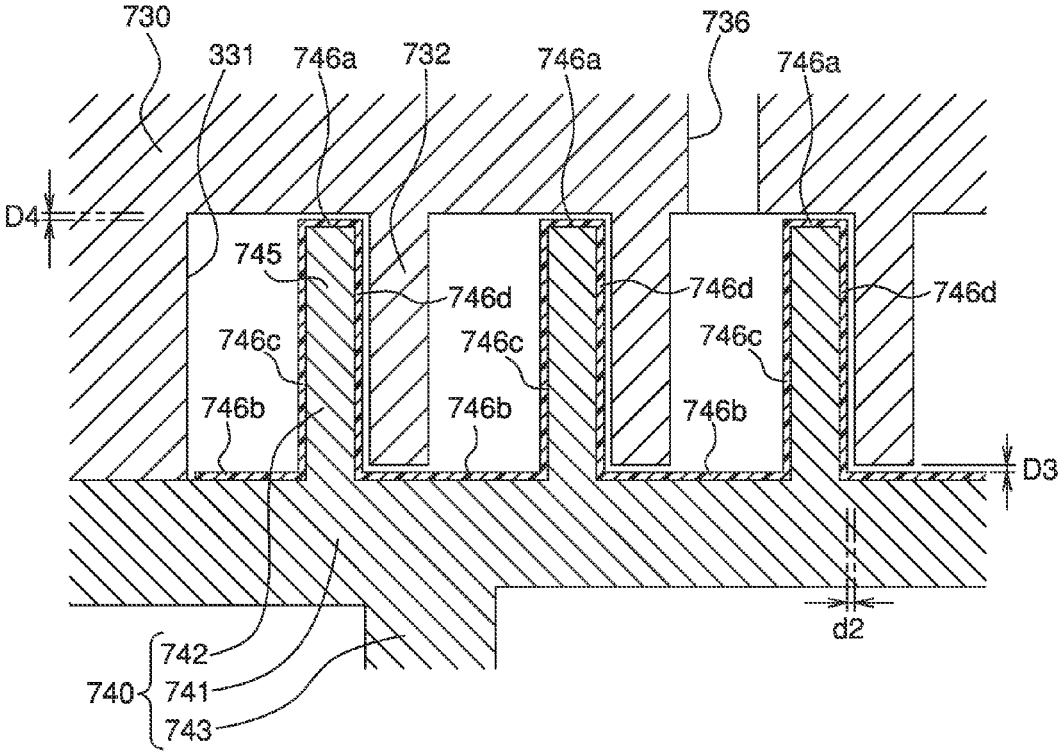
FIG. 24(*a*) is a partially enlarged v1ew of FIG. 22, and FIG. 24 (*b*) is a partially enlarged view of FIG. 23.
Figure 24B:
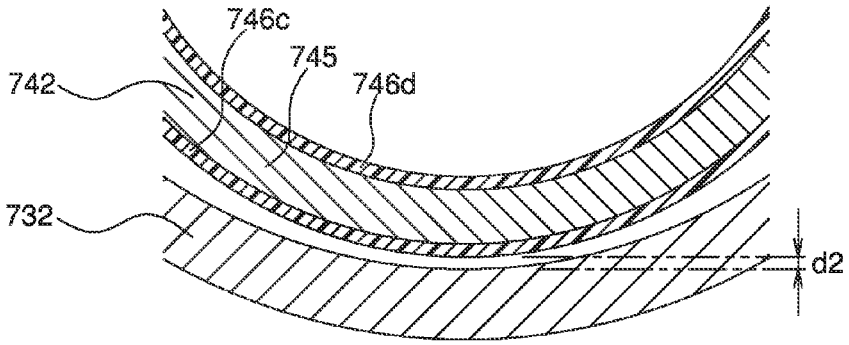

FIG. 24(*b*) show the compressor 701 at the time of shipment. As shown in FIG. 24(*b*), the moveable-side wrap 742 is formed so as to move along the side surface of the fixed-side wrap 732 when the moveable scroll 740 circles, while the side surface of the moveable-side wrap 742 approximates to the side surface of the fixed-side wrap 732 and the circumferential wall of the recess 731 with a minute gap d2 (hereinafter, the gap is referred to as radial-directional gap d2) of, for example, 10 to 30 μm therebetween. Further, as shown in FIG. 24(*a*), between the top surface of the flat plate section 741 of the moveable scroll 740 and the leading end surface of the fixed-side wrap 732, and between the bottom surface of the recess 731 of the fixed scroll 730 and the leading end surface of the moveable-side wrap 742, there are minute gaps D3, D4 (hereinafter, these gaps are referred to as axial directional gaps D3, D4) of, for example, approximately 10 to 30 μm, respectively.

As shown in FIG. 24, the moveable scroll 740 of the present embodiment includes: a base 745 made of a metal material and resin layers 746*a* to 746*d* which are thin films covering the surfaces of the base 745. The shape of the base 745 is substantially the shape of the moveable scroll 740. The base 745 is formed by sintering of metal powder, casting, or cutting.

<Resin Layer>

As shown in FIG. 24(*a*), the resin layer 746*a* is formed on a leading end surface of the moveable-side wrap 742. Further, the resin layer 746*b* is formed in an area of the top surface of the flat plate section 741, which opposes the bottom surface of the recess 731 (an area of the fixed-side wrap 732 opposing the leading end surface). Further, as shown in FIG. 24(*a*) and FIG. 24 (*b*), the resin layers 746*c*, 746*d* are formed on the outer circumference surface and the inner circumference surface of the moveable-side wrap 742. The material of the resin layers 746*a* to 746*d* and the film thickness of the same at the time of shipment are the same as the resin layers 44*a*, 44*c* on the piston 40 of First Embodiment. Note that, as in First Embodiment, the resin layers 746*a* to 746*d* at the time of shipment are hardly swollen.

<Operation of Compressor>

Next, the following describes an operation of the compressor 701 of the present embodiment, with reference to FIG. 23(*a*) to FIG. 23(*d*), FIG. 23(*b*) to FIG. 23(*d*) show the states where the shaft 708 has rotated by 90°, 180°, and 270° from the state shown in FIG. 23 (*a*).

When the motor 707 is driven to rotate the shaft 708, while the refrigerant is supplied from the inlet pipe fitting 703 to the recess 731 through the draw-in path 733, the moveable scroll 740 mounted to the eccentric portion 708*a* circles without rotating, as shown in FIG. 23(*a*) to FIG. 23(*d*). With this, the substantially crescent spaces formed by the side surfaces of the moveable-side wrap 742, the fixed-side wrap 732, and the circumferential wall of the recess 731 move towards the center, while reducing their volumes. This way the refrigerant is compressed in the recess 731.

In the following description, with reference to FIG. 23(*a*), on the process of compressing the refrigerant, the substantially crescent spaces (spaces indicated by dot hatching in the figure) at the outermost circumference is focused. In the state shown in FIG. 23(*a*), the refrigerant is supplied from the draw-in path 733 into the substantially crescent space. When the shaft 708 rotates from this state, the volume of the space increases as shown in FIG. 23(*b*), and the refrigerant is drawn in from the draw-in path 733. When the shaft 708 further rotates from this state, the crescent space moves towards the center as shown in FIG. 23(*c*) and FIG. 23(*d*), and the space is no longer in communication with the draw-in path 733 and its volume decreases. Therefore, in this space, the refrigerant is compressed. With the rotation of the shaft 708, the space further moves towards the center and shrinks. When the shaft 708 rotates twice, the space moves to the position indicated by grid hatching in FIG. 23(*a*). When the shaft 708 further rotates, the space matches with a space surrounded by the inner circumference surface of the moveable-side wrap 742 and the outer circumference surface of the fixed-side wrap 732, and is in communication with the discharge hole 736 as indicated by the grid hatching in FIG. 23(*c*). This way, the compressed refrigerant in the space is ejected from, the discharge hole 736.

The refrigerant ejected from the discharge hole 736 passes the communication hole 737 of the fixed scroll 730 and the communication hole 725 of the housing 720 and then discharged into the space below the housing 720. Then, the refrigerant is finally ejected to the outside the closed casing 702 from the outlet pipe fitting 704.

As hereinabove mentioned, the axial directional gaps D3, D4 are formed between the leading end surface of the fixed-side wrap 732 and the top surface of the flat plate section 741 of the moveable scroll 740 and between the leading end surface of the moveable-side wrap 742 and the bottom, surface of the recess 731 of the fixed, scroll 730, respectively (see FIG. 24). Therefore, during an ordinary operation of the compressor 701, there is the lubricating oil L discharged from the outlet hole 708*c* of the shaft 708 in the axial directional gaps D3, D4 (illustration omitted).

Further, as hereinabove described, the radial-directional gap d2 is formed in a plurality of parts between the side surface of the move able-side wrap 742, the side surface of the fixed-side wrap 732, and the circumferential wall of the recess 731 (see FIG. 24). Therefore, during an ordinary operation of the compressor 701, there is the lubricating oil L discharged from the outlet hole 708*c* of the shaft 708 in the radial-directional gap d2.

[Characteristic of Compressor of Seventh Embodiment]

As in First Embodiment, in the compressor of the present embodiment, the frictional loss is reduced while the resin layer is kept from separating from the base.

Thus, embodiments of the present invention are described hereinabove with reference to the drawings. However, the specific structure of the present invention shall not be interpreted as to be limited to the above described embodiments. The scope of the present invention is defined not by the above embodiments but by claims set forth below, and shall encompass the equivalents in the meaning of the claims and every modification within the scope of the claims.

Figure 25:
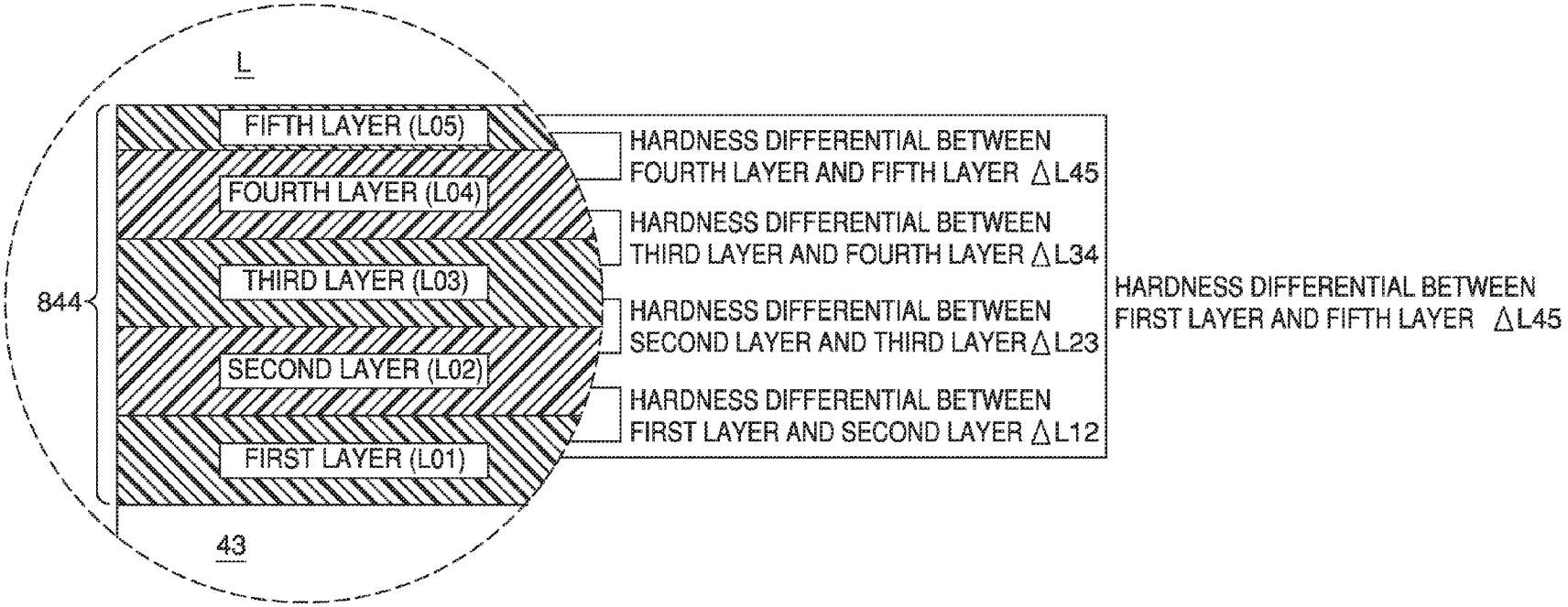
FIG. 25 is a diagram showing a modification of the compressor related to First Embodiment, according to the present invention.

The above described First to Seventh Embodiments deal with a case where the hardness of each layer in the resin layer is such that, the more distant the layer is from the base, the less the hardness becomes; however, the present, invention is not limited to those embodiments. As shown in FIG. 25, in a resin layer 844 which is a stack of five layers, i.e., a first layer to a fifth layer, the hardness LOS of the fifth layer most distant from the base 43 is smaller than the hardness L01 of the first layer closest, to the base 43, and the hardness differential (ΔL12, ΔL23, ΔL34, ΔL45) of two adjacent layers is smaller than the hardness differential (ΔL15) between the first layer and the fifth layer. Thus, for example, the hardness of each of the five layers, i.e., first layer to the fifth layer, may be such that, the more distant the layer is from the base, the less the hardness becomes.

The above described First to Seventh Embodiments deal with a case where the hardness of each of the layers constituting the resin layer is smaller than the hardness of the metal material of a member opposing to the resin layer; however, as long as the hardness of the layer most distant from the base is smaller than the hardness of the metal material, the hardnesses of the other layers may be greater than the hardness of the metal material.

The above described First to Seventh Embodiments deal with a case where a layer closest to the base and a layer most distant from, the base in the resin, layer do not contain an anti-swelling agent; however, the present, invention is not limited to those embodiments, as long as one of the layer closes to the base and the layer most distant from the base is a layer not containing the anti-swelling agent.

Therefore, the layer closest to the base may contain an anti-swelling agent, while the layer most distant from the base contains no anti-swelling agent. This reduces the frictional loss, and restrains deterioration in the efficiency of the compressor, even when the layer most distant from the base slides in contact with another member.

Further, the layer closest to the base may contain no anti-swelling agent, while the layer most distant from the base contains an anti-swelling agent. This prevents separation of the resin layer from the base.

Further, the above described First to Seventh Embodiments deal with a case where the layer between the layer closest to the base and the layer most distant from the base in the resin layer contain an anti-swelling agent; however, the present, invention is not limited to the embodiments, as long as any one of layers constituting the resin layer contains the anti-swelling agent.

The above described First to Seventh Embodiments deal with a case where the bend elastic constant of each of the layers constituting the resin layer is smaller than the Young's modulus of two members provided to sandwich the resin layer. However, as long as the bend elastic constant of at least one layer out of the layers constituting the resin layer is smaller than the Young's modulus of the two members, the bend elastic constant of each of the other layers may be greater than the Young's modulus of the two members.

The above described First Embodiment deals with a case where the resin layers 44*a*, 44*b* are formed in a whole area of the upper end surface and a whole area of the lower end surface of the base 43, respectively; however, the present invention is not limited to the embodiment, and the resin layers 44*a*, 44*b* may be formed in a part of the upper end surface and in a part of the lower end surface of the base 43, respectively.

The above described Second Embodiment deals with a case where the resin layer 244 is formed in a part of the under surface of the front head 220, which part including an area where the top surface of the piston 40 slides, and the resin layer 245 is formed in a part of the top surface of the rear head 250, which part includes an area where the under surface of the piston 40 slides. However, the present invention is not limited to the embodiment. The resin layer 244 may be formed in a whole area of the under surface of the front head 220, and the resin layer 245 may be formed in a whole area of the top surface of the rear head 250.

The above described First to Seventh Embodiments deal with a case where the resin layer includes three or four layers; however, the present invention is not limited to the embodiments, and the number of layers in the resin layer may be five or more.

The above described First Embodiment deals with a case where the thickness of each of the first layer to the third layer in each of the resin layers 44*a*, 44*b* is the same; however, the present invention is not limited to the embodiment, and as long as the thickness t2 of the fourth layer is not more than 50% of the thickness T1 of each of the entire resin layers 44*a*, 44*b*, the thickness of each of the first layer to the third layer is not particularly limited.

The above described First Embodiment deals with a case where the thickness t2 of the fourth layer is smaller than the thickness t1 of each of the first layer to the third layer. However, the present invention is not limited to the embodiment, and the thickness t2 of the fourth layer may be equal to or greater than the thickness t1 of each of the first layer to the third layer, as long as the thickness t2 of the fourth layer is not more than 50% of the thickness T1 of each of the entire resin layers 44*a*, 44*b*.

The above described Sixth Embodiment deals with a case where the resin layer is formed in whole areas of the upper end surface, the lower end surface, and the outer circumference surface of the roller 641, and in whole areas of the upper and lower end surfaces of the vane 642. However, the present invention is not limited to the embodiment. Resin layers 244, 245 (see FIG. 8, FIG. 9) similar to those of Second Embodiment, according to the present invention may be formed in a whole area or in a part of the under surface of the front head and in a whole area or in a part of the top surface of the rear head. Further, a resin layer 344 (see FIG. 12 to FIG. 14) similar to that of Third Embodiment may be formed in a whole area or in a part of the outer circumference surface of the roller 641. Further, a resin layer 444 (see FIG. 16) similar to that of Fourth Embodiment may be formed in a whole area or in a part of the inner circumference of the cylinder 630.

The above described Seventh Embodiment deals with a case where a resin layer is formed on the end surface of the moveable-side wrap (second wrap) 742, an area of the top surface of the flat plate section 741 opposing to the bottom surface of the recess 731 (area opposing to the end surface of the fixed-side wrap (first wrap) 732), and on the outer circumference surface and the inner circumference of the moveable-side wrap 742. However, the present invention is not limited to the embodiment, and the similar resin layer may be formed in other parts (specifically, the end surface of the fixed-side wrap 732, a part of the bottom surface of the recess 731, opposing to the end surface of the moveable-side wrap 742, a side surface of the fixed-side wrap 732, and a circumferential wall of the recess 731).

Industrial Applicability

The present invention realizes a compressor structured so as to restrain deterioration in the efficiency of the compressor, while preventing separation of a resin layer formed on an end surface of the piston or the like.

What is claimed is:

1. A compressor, comprising:

a cylinder having a compression chamber and a blade housing in communication with the compression chamber;

a first end plate member and a second end plate member disposed on axial ends of the cylinder; and a piston disposed in the compression chamber and inside the blade housing, the piston including an annular roller disposed in the compression chamber and a blade extending from an outer circumference surface of the roller and disposed in the blade housing so as to be movable forward and backward;

a resin layer including a stack of three or more layers being formed on at least a portion of at least one of an axial direction end surface of the piston, a surface of the first end plate member opposed to the axial direction end surface of the piston, a surface of the second end plate member opposed to the axial direction end surface of the piston, the outer circumference surface of the roller, and an inner circumference surface of the compression chamber, a hardness of a layer most distant from a base in the resin layer being smaller than a hardness of a layer closest to the base in the resin layer, and a difference in hardness between two adjacent layers in the resin layer being smaller than a difference in hardness between the layer most distant from the base and the layer closest to the base.

2. The compressor according to claim 1, wherein the three or more layers include a layer containing an anti-swelling agent, and the layer most distant from the base does not contain the anti-swelling agent.

3. The compressor according to claim 1, wherein the three or more layers include a layer containing an anti-swelling agent, and the layer closest to the base does not contain the anti-swelling agent.

4. The compressor according to claim 1, wherein the hardness of each of the three or more layers is such that, the more distant the layer is from the base, the less the hardness of the layer.

5. The compressor according to claim 1, wherein a thickness of the layer most distant from the base is not more than 50% of a thickness of the resin layer.

6. The compressor according to claim 1, wherein the hardness of the layer most distant from the base is smaller than a hardness of a surface opposing to the resin layer, the surface being on a side opposite to the base with respect to the resin layer.

7. The compressor according to claim 1, wherein an end surface of the first wrap, a surface opposing to the end surface of the first wrap on the flat plate section, an end surface of the second wrap, a surface opposed to the end surface of the second wrap on the bottom surface of the recess, the side surface of the first wrap, the side surface of the second wrap, and a circumference surface of the recess, a hardness of a layer most distant from a base in the resin layer being smaller than a hardness of a layer closest to the base in the resin layer, and a difference in hardness between two adjacent layers in the resin layer being smaller than a difference in hardness between the layer most distant from the base and the layer closest to the base.

8. The compressor according to claim 1, wherein each layer of the stack of three or more layers has different hardness by adjusting a blending ratio of two types of materials.

9. The compressor according to claim 1, wherein layers of the stack of three or more layers are idential with one another in types of blended resin materials but are different from one another in a blending ratio of the same types of the resin materials.

10. A compressor, comprising:

a cylinder having a compression chamber and a vane housing in communication with the compression chamber;

a first end plate member and a second end plate member disposed on axial ends of the cylinder;

an annular roller disposed inside the compression chamber; and a vane having a leading end pressed against an outer circumference surface of the roller, the vane being disposed in the vane housing so as to be movable forward and backward, a resin layer including a stack of three or more layers being formed on at least a portion of at least one of
an axial direction end surface of the roller,
a surface of the first end plate member opposed to the axial direction end surface of the roller,
a surface of the second end plate member opposed to the axial direction end surface of the roller,
the outer circumference surface of the roller, and
an inner circumference surface of the compression chamber, a hardness of a layer most distant from a base in the resin layer being smaller than a hardness of a layer closest to the base in the resin layer, and a difference in hardness between two adjacent layers in the resin layer being smaller than a difference in hardness between the layer most distant from the base and the layer closest to the base.

11. The compressor according to claim 10, wherein the three or more layers include a layer containing an anti-swelling agent, and the layer most distant from the base does not contain the anti-swelling agent.

12. The compressor according to claim 10, wherein the three or more layers include a layer containing an anti-swelling agent, and the layer closest to the base does not contain the anti-swelling agent.

13. The compressor according to claim 10, wherein the hardness of each of the three or more layers is such that, the more distant the layer is from the base, the less the hardness of the layer.

14. The compressor according to claim 10, wherein a thickness of the layer most distant from the base is not more than 50% of a thickness of the resin layer.

15. The compressor according to claim 10, wherein the hardness of the layer most distant from the base is smaller than a hardness of a surface opposing to the resin layer, the surface being on a side opposite to the base with respect to the resin layer.

16. The compressor according to claim 10, wherein each layer of the stack of three or more layers has different hardness by adjusting a blending ratio of two types of materials.

17. The compressor according to claim 10, wherein layers of the stack of three or more layers are identical with one another in types of blended resin materials but are different from one another in a blending ratio of the same types of the resin materials.

18. A compressor, comprising:

a first scroll having a recess and a first wrap, the first wrap being spiral shaped and projecting from a bottom surface of the recess;

a second scroll having a recess and a second wrap, the second wrap being spiral shaped and projecting from a flat plate section, the first scroll and the second scroll being closely located relative to each other so that the bottom surface of the recess and the flat plate section oppose each other, and a side surface of the first wrap and a side surface of the second wrap oppose each other, a resin layer which is a stack of three or more layers is formed on at least a portion of at least one of the hardness of the layer most distant from the base is smaller than a hardness of a surface opposing to the resin layer, the surface being on a side opposite to the base with respect to the resin layer.

19. The compressor according to claim 18, wherein the three or more layers include a layer containing an anti-swelling agent, and the layer most distant from the base does not contain the anti-swelling agent.

20. The compressor according to claim 18, wherein the three or more layers include a layer containing an anti-swelling agent, and the layer closest to the base does not contain the anti-swelling agent.

21. The compressor according to claim 18, wherein the hardness of each of the three or more layers is such that, the more distant the layer is from the base, the less the hardness of the layer.

22. The compressor according to claim 18, wherein a thickness of the layer most distant from the base is not more than 50% of a thickness of the resin layer.

23. The compressor according to claim 18, wherein a bend elastic constant of at least one of the three or more layers of the resin layer is smaller than a Young's modulus of at least one of two members disposed so as to sandwich the resin layer.

24. The compressor according to claim 18, wherein a bend elastic constant of at least one of the three or more layers of the resin layer is smaller than a Young's modulus of at least one of two members disposed so as to sandwich the resin layer.

25. The compressor according to claim 18, wherein each layer of the stack of three or more layers has different hardness by adjusting a blending ratio of two types of materials.

26. The compressor according to claim 18, wherein layers of the stack of three or more layers are identical with one another in types of blended resin materials but are different from one another in a blending ratio of the same types of the resin materials.

* * * * *